US011760547B2

(12) United States Patent
Helseth et al.

(10) Patent No.: US 11,760,547 B2
(45) **Date of Patent: *Sep. 19, 2023**

(54) TWIST-TIE DISPENSING ASSEMBLY

(71) Applicant: Twist-Ease, Inc., Crystal, MN (US)

(72) Inventors: James R. Helseth, Plymouth, MN (US); Jeffrey Michael Helseth, Minneapolis, MN (US); Matthew James Helseth, Plymouth, MN (US); David J. Benson, Eagan, MN (US); David Edwin Bade, Stillwater, MN (US)

(73) Assignee: Twist-Ease, Inc., Crystal, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/564,900

(22) Filed: Dec. 29, 2021

(65) Prior Publication Data

US 2022/0250817 A1 Aug. 11, 2022

Related U.S. Application Data

(63) Continuation of application No. 16/549,060, filed on Aug. 23, 2019, now Pat. No. 11,214,420.

(60) Provisional application No. 62/722,594, filed on Aug. 24, 2018.

(51) Int. Cl.
*B65D 63/10* (2006.01)

(52) U.S. Cl.
CPC ..... *B65D 63/10* (2013.01)

(58) Field of Classification Search
CPC ..... B65D 83/02; B65D 63/10
See application file for complete search history.

(56) References Cited

U.S. PATENT DOCUMENTS

| | | | |
|---|---|---|---|
| 628,642 | A | 7/1899 | Wyman |
| 740,001 | A | 9/1903 | Flanagin |
| 1,441,359 | A | 1/1923 | Langston |
| 2,050,394 | A | 8/1936 | Straubel |
| D156,922 | S | 1/1950 | Sonntag |
| 2,973,597 | A | 3/1961 | Powell |
| 2,984,161 | A | 5/1961 | Cook et al. |
| 3,068,135 | A | 12/1962 | Bower |
| 3,207,564 | A | 9/1965 | Patrick et al. |
| 3,290,854 | A | 12/1966 | MacMurray |
| 3,409,948 | A | 11/1968 | Goodwin |
| 3,774,755 | A | 11/1973 | Cast et al. |
| 4,052,886 | A | 10/1977 | Buick |
| D261,452 | S | 10/1981 | Chandler |
| 4,340,144 | A | 7/1982 | Cousins |
| 4,411,374 | A | 10/1983 | Hotchkiss |

(Continued)

*Primary Examiner* — Gene O Crawford
*Assistant Examiner* — Ayodeji T Ojofeitimi
(74) *Attorney, Agent, or Firm* — Merchant & Gould P.C.

(57) ABSTRACT

A twist-tie dispensing assembly for dispensing of loose twist-ties in bulk form comprises a base defining a rear wall and an open front, wherein a flexible portion of the rear wall is configured to elastically deflect through a cut-out provided on the rear wall in a direction from the rear wall toward the open front. A box is mounted to the base, the box defining a back wall and a storage compartment configured to hold twist-ties, the back wall of the base defining a slot exposing the storage compartment to an exterior of the box, wherein the slot is configured to receive at least partially the flexible portion of the rear wall of the base from the exterior of the box toward the storage compartment when the box is mounted to the base.

20 Claims, 26 Drawing Sheets

(56) References Cited

U.S. PATENT DOCUMENTS

| | | | |
|---|---|---|---|
| 4,509,231 | A | 4/1985 | Paxton |
| 4,529,636 | A | 7/1985 | Olsen |
| 4,537,330 | A | 8/1985 | Gelbard |
| 4,543,862 | A | 10/1985 | Levene et al. |
| 4,558,813 | A | 12/1985 | Richards |
| 4,596,195 | A | 6/1986 | Wenger |
| D285,719 | S | 9/1986 | Conlon |
| 4,621,732 | A | 11/1986 | Olson |
| D294,908 | S | 3/1988 | Childress |
| 4,815,610 | A | 3/1989 | Borick et al. |
| 4,842,230 | A | 6/1989 | Cobb et al. |
| 4,948,202 | A | 8/1990 | Helseth |
| D323,594 | S | 2/1992 | Helseth |
| 5,092,830 | A | 3/1992 | Helseth |
| 5,213,400 | A | 5/1993 | Helseth |
| 5,232,431 | A | 8/1993 | Helseth |
| 5,579,971 | A | 12/1996 | Chuang |
| D395,566 | S | 6/1998 | Helseth |
| 5,871,115 | A | 2/1999 | Kohn |
| 5,961,434 | A | 10/1999 | Helseth |
| 6,217,500 | B1 | 4/2001 | Helseth et al. |
| 8,292,139 | B2 | 10/2012 | Golub et al. |
| 9,186,038 | B2 | 11/2015 | Bastuji |
| 9,737,141 | B2 | 8/2017 | Johnson |
| 11,214,420 | B2 | 1/2022 | Helseth et al. |
| 2003/0000905 | A1 | 1/2003 | Zidek |
| 2008/0041901 | A1 | 2/2008 | Chuang |
| 2012/0062085 | A1 | 3/2012 | Bastuji et al. |
| 2012/0097701 | A1 | 4/2012 | Benedetti |
| 2015/0034513 | A1 | 2/2015 | Helseth |
| 2016/0051330 | A1 | 2/2016 | Cosentino, II |
| 2017/0112297 | A1 | 4/2017 | Helseth et al. |
| 2017/0129670 | A1 | 5/2017 | Milbrandt et al. |

TWIST-TIE DISPENSING ASSEMBLY

CROSS REFERENCE TO RELATED APP

This application is a continuation of U.S. application Ser. No. 16/549,060, filed Aug. 23, 2019, now U.S. Pat. No. 11,214,420; which claims the benefit of U.S. Provisional Application Ser. No. 62/722,594, filed Aug. 24, 2018, which applications are hereby incorporated by reference in their entireties.

FIELD

The present disclosure relates generally to twist-tie dispensers and methods of use.

BACKGROUND

There are many uses for twist-ties. In a grocery store, for example, consumers commonly place produce items, bakery items, bulk food items, and the like in bags and use twist-ties to temporarily close the bags. In such uses, sanitary conditions are very important and, therefore, consideration should be given to the manner in which the twist-ties are dispensed. Further, spillage of twist-ties is a concern for safety reasons among others. Quick and cost-effective refill or replacement of the twist-ties or the dispensers thereof is also advantageous.

For the reasons stated above and for other reasons stated below, which will become apparent to those skilled in the art upon reading and understanding the present specification, there is a need in the art for improved twist-tie dispensers.

SUMMARY

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, the twist-tie dispenser is configured as a disposable product, wherein the dispenser can be thrown away or disposed of once the twist-tie cluster is spent. According to one embodiment, the twist-tie dispenser comprises a base and a twist-tie cluster attached to the base. The base includes a top portion, which may be generally U-shaped and form a pocket that is for receiving the twist-tie cluster. The base also includes a rear portion or wall that defines mounting members used for mounting the base to a fixture.

According to one example, the mounting members may be defined by hook-like extensions that protrude from the rear wall of the base, wherein the hook-like extensions are configured to receive elongate, rod-like mounting structures of a fixture to which the disposable twist-tie dispenser is to be mounted. The hook-like extensions may fit over the elongate, rod-like mounting structures of the fixture. In addition to the hook-like extensions, the rear wall of the base may define a flexible portion that is used for latching and unlatching the dispenser to the fixture.

The flexible portion acts as a cantilever. In some embodiments, the flexible portion defines ramped tabs with latching surfaces that oppose and cooperate with upper stop surfaces formed by the hook-like extensions for latching the dispenser to the fixture. When the twist-tie cluster is spent and the dispenser needs to be removed and replaced, the flexible portion may be elastically flexed toward the front of the dispenser to clear the latching surfaces from the rod-like mounting structures of the fixture. In this manner, the dispenser can be lifted off the fixture.

According to another aspect of the disclosure, a twist-tie dispenser comprises a base including a top portion defining a twist-tie cluster mounting surface, a rear wall extending downward from the top portion, and an open front. A latching structure configured for removably mounting the base to a fixture including at least one rod-like mounting structure is defined at least in part by a first hook-like extension protruding from the rear wall of the base, the first hook-like extension defining a pocket formed by an upper stop surface and a vertical retention surface, the latching structure also defined at least in part by a flexible portion of the rear wall that is configured to elastically deflect through a cut-out provided on the rear wall in a direction from the rear wall toward the open front when the rod-like mounting structure of the fixture is inserted into the pocket of the first hook-like extension, the flexible portion also defining a lower stop surface that opposes the upper stop surface of the first hook-like extension when the rod-like mounting structure is within the pocket of the first hook-like extension and is captured between the lower stop surface and the upper stop surface.

According to another aspect of the disclosure, the twist-tie dispenser includes the twist-tie cluster integrally mounted to the top portion of the base, and the dispenser including the twist-tie cluster is mounted and removed from the fixture as an integral disposable unit.

According to yet another aspect, the disclosure is directed to a method of using a twist-tie dispenser, the method comprising providing a twist-tie dispenser comprising a base including a top portion defining a twist-tie cluster mounting surface, a rear wall extending downward from the top portion, and an open front, the dispenser further comprising a latching structure configured for removably mounting the base to a fixture including at least one rod-like mounting structure, the latching structure defined at least in part by a first hook-like extension protruding from the rear wall of the base, the first hook-like extension defining a pocket formed by an upper stop surface and a vertical retention surface, the latching structure also defined at least in part by a flexible portion of the rear wall that is configured to elastically deflect through a cut-out provided on the rear wall in a direction from the rear wall toward the open front when the rod-like mounting structure of the fixture is inserted into the pocket of the first hook-like extension, the flexible portion also defining a lower stop surface that opposes the upper stop surface of the first hook-like extension when the rod-like mounting structure is within the pocket and is captured between the lower stop surface and the upper stop surface, slidably inserting the rod-like structure of the fixture into the pocket of the first hook-like extension until abutting the upper stop surface, and while slidably inserting the rod-like structure of the fixture into the pocket of the first hook-like extension, deflecting the flexible portion of the rear wall through the cut-out provided on the rear wall until the rod-like structure is captured between the upper stop surface of the first hook-like extension and the lower stop surface defined by the flexible portion.

The method may further comprise removing the twist-tie dispenser from the fixture by re-deflecting the flexible portion toward the open front through the cut-out provided on the rear wall until the rod-like structure clears the lower stop surface and slidably lifting the base upward relative to the fixture.

Yet according to another aspect of the disclosure, a base for one of the example twist-tie dispensers may be oriented upside down and receive a twist tie storage box for bulk dispensing of twist ties. The base may be mounted to the same fixture that includes rod-like structures by using the same hook-like extensions. A flexible portion formed by the rear wall of the base may be inserted through a slot defined by the back wall of the box when placing the box within the pocket of the base. The flexible portion of the base is inserted from the rear side of the back wall toward the front side of the back wall of the box, wherein an upper half of the flexible portion ends up positioned within the storage compartment defined by the box. The coupling of the flexible portion of the base to the box via the slot provides extra stability to the box within the pocket and limits unwanted removal of the box during dispensing of loose twist-ties. Since the flexible portion of the base is biased rearwardly, a frictional hold is generally created between the box and the rear wall of the base. At least a portion of the back wall of the box becomes captured between the flexible portion of the base and the rest of the rear wall of the base.

According to another aspect, the disclosure is directed to a twist-tie dispensing assembly comprising a base defining a rear wall and an open front, wherein a flexible portion of the rear wall is configured to elastically deflect through a cut-out provided on the rear wall in a direction from the rear wall toward the open front and a box mounted to the base, the box defining a back wall and a storage compartment configured to hold twist-ties, the back wall of the base defining a slot exposing the storage compartment to an exterior of the box, wherein the slot is configured to receive at least partially the flexible portion of the rear wall of the base from the exterior of the box toward the storage compartment when the box is mounted to the base.

According to another aspect, the disclosure is directed to a method of assembling a twist-tie dispenser, the method comprising mounting a box having a storage compartment that is configured for holding twist-ties to a base defining a rear wall and an open front, wherein a flexible portion of the rear wall is configured to elastically deflect through a cut-out provided on the rear wall in a direction from the rear wall toward the open front and inserting at least partially the flexible portion of the rear wall of the base through a slot defined at a back wall of the box from an exterior of the box toward the storage compartment. The base may be mounted to a fixture.

According to another aspect, the disclosure is directed to a box for holding twist-ties, the box comprising a storage compartment defined by a bottom wall, a back wall, a front wall, two opposing side walls, and a dispensing opening exposing the storage compartment to an exterior of the box for dispensing of twist-ties, wherein the back wall of the base also defines a slot in addition to the dispensing opening, wherein the slot also exposes the storage compartment to the exterior of the box, wherein the slot is configured to receive at least a portion of a box-holding structure.

BRIEF DESCRIPTION OF THE DRAWINGS

The inventive aspects of the present disclosure can be more easily understood, and further advantages and uses thereof can be more readily apparent, when considered in view of the detailed description and the following Figures in which.

In accordance with common practice, the various described features are not drawn to scale but are drawn to emphasize specific inventive features relevant to the present disclosure. Reference characters denote like elements throughout the Figures and the text.

DETAILED DESCRIPTION

In the following detailed description, reference is made to the accompanying drawings, which form a part hereof, and in which is shown by way of illustration, embodiments in which the inventions may be practiced. These embodiments are described in sufficient detail to enable those skilled in the art to practice the inventive features, and it is to be understood that other embodiments may be utilized and mechanical changes may be made without departing from the spirit and scope of the present disclosure. The following detailed description is, therefore, not to be taken in a limiting sense, and the scope of the present inventive features are defined only by the claims and equivalents thereof.

Embodiments of the present disclosure provide improved twist-tie dispensers.

Figure 15:
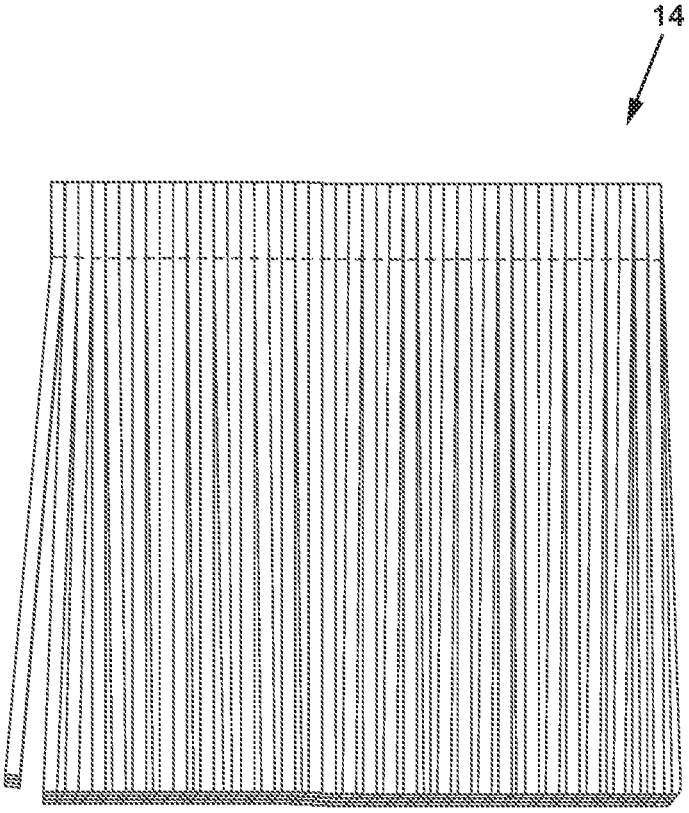
FIG. 15 illustrates an example of a twist-tie cluster configured to be fixed to any of the dispensers shown in FIGS. 1-14.

According to one embodiment, the twist-tie dispenser 10 is configured as a disposable device, wherein the entire dispenser 10 can be removed from a fixture 12 at a customer location such as a grocery store and thrown away or disposed of once a twist-tie cluster 14 is spent. In such an embodiment, the twist-tie cluster 14 may be provided with/attached to the dispenser 10 as an integral unit. The twist-tie cluster 14 may be attached to the dispenser 10 in a variety of ways known in the art including via adhesives. Once the twist-ties of the cluster 14 are used and the entire cluster 14 is spent, the entire dispenser 10, along with the portion of the cluster 14 that has adhesively been attached to the dispenser 10, can be disposed. An example of a twist-tie cluster 14 that can be fixed to any of the dispensers discussed in the present application is shown in FIG. 15.

Figure 1:
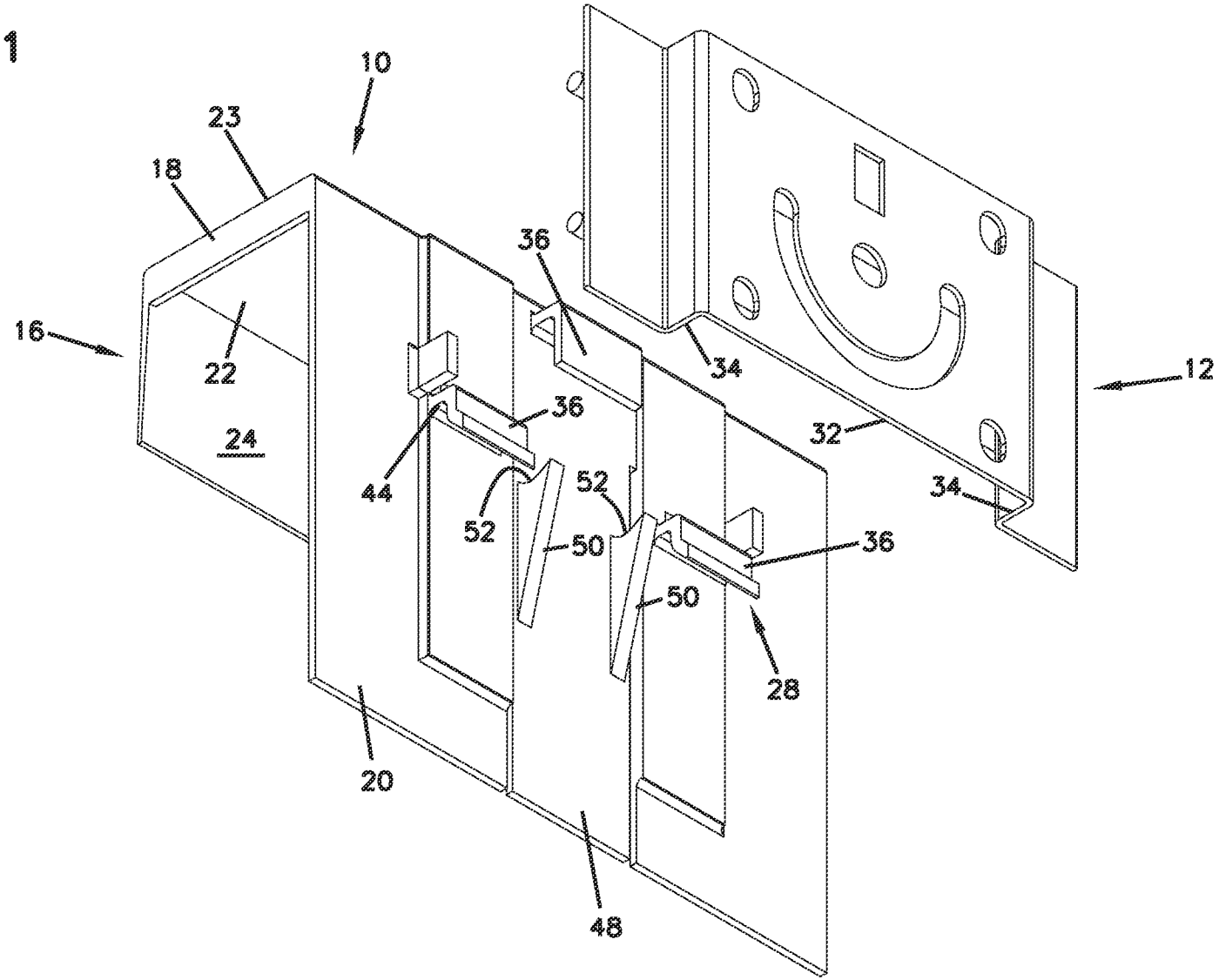
FIG. 1 is a rear perspective view of a base of a twist-tie dispenser having features that are examples of inventive aspects in accordance with the present disclosure, the twist-tie dispenser shown with a fixture to which the dispenser may be attached.
Figure 2:
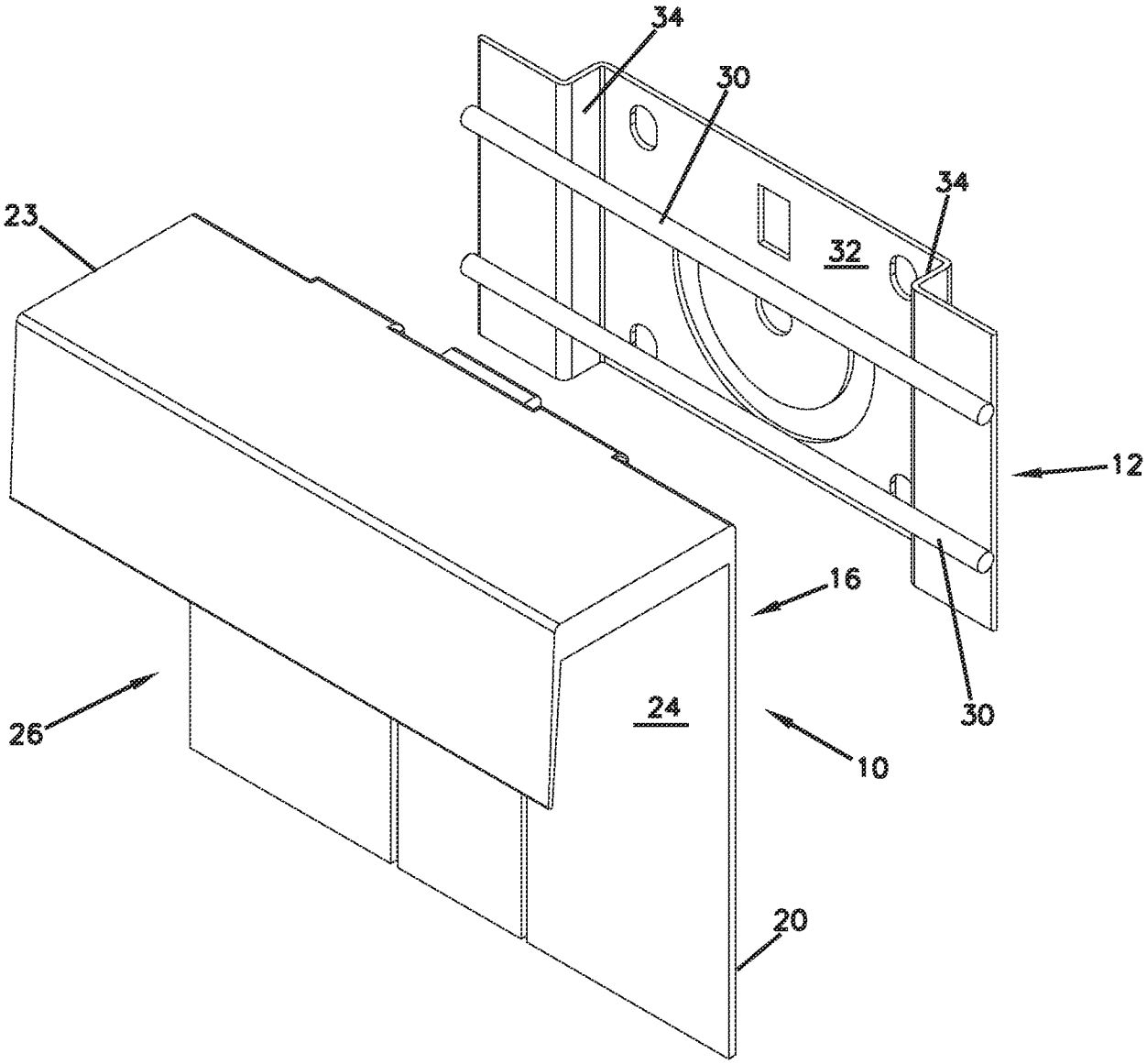
FIG. 2 is a front perspective view of the base of the twist-tie dispenser and fixture of FIG. 1.
Figure 3:
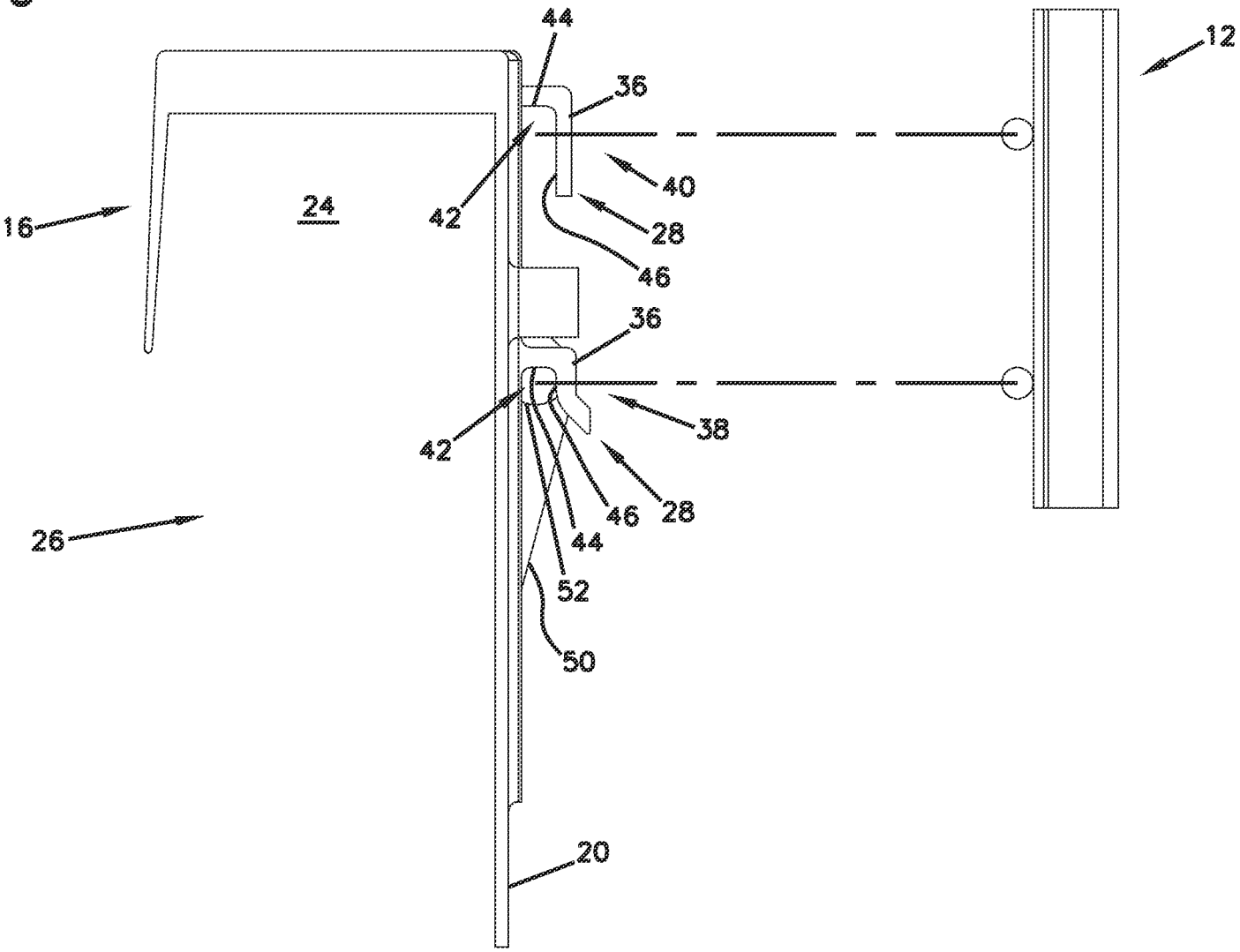
FIG. 3 is a side view of the base of the twist-tie dispenser and fixture of FIG. 1.
Figure 4:
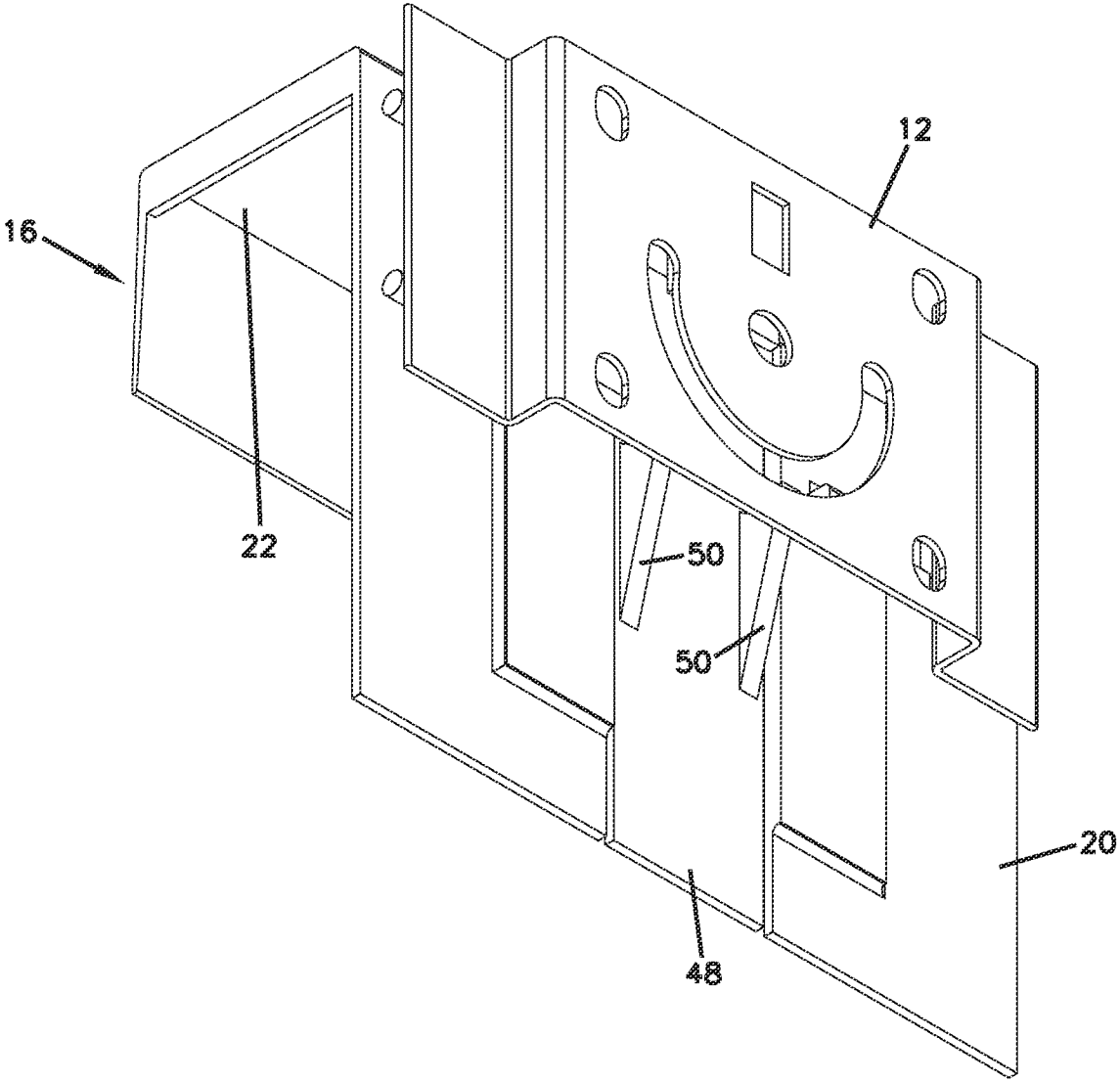
FIG. 4 illustrates a rear perspective view of the twist-tie dispenser of FIGS. 1-3 mounted on the fixture of FIGS. 1-3.
Figure 5:
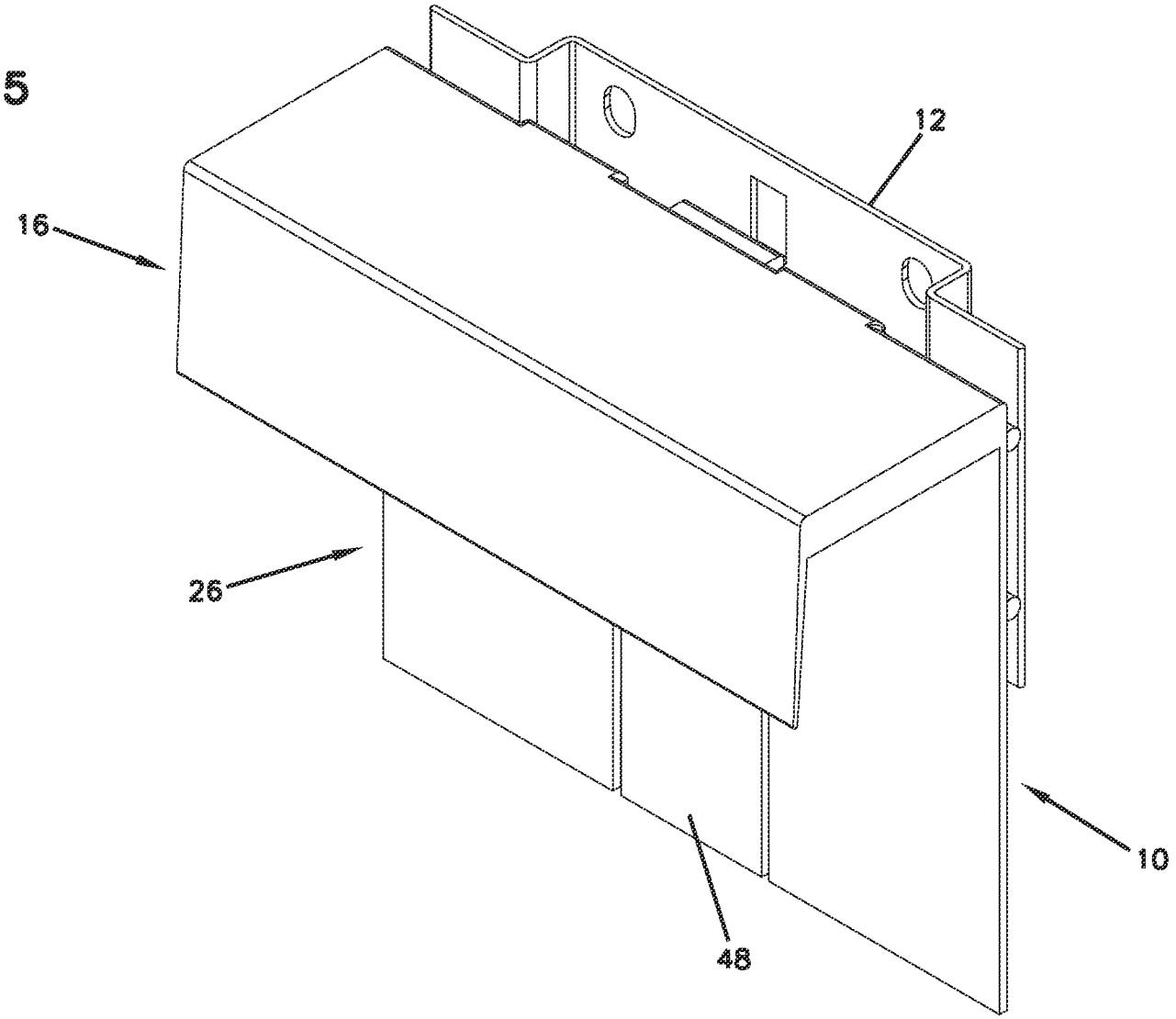
FIG. 5 is a front perspective view of the twist-tie dispenser mounted on the fixture of FIG. 4.
Figure 6:
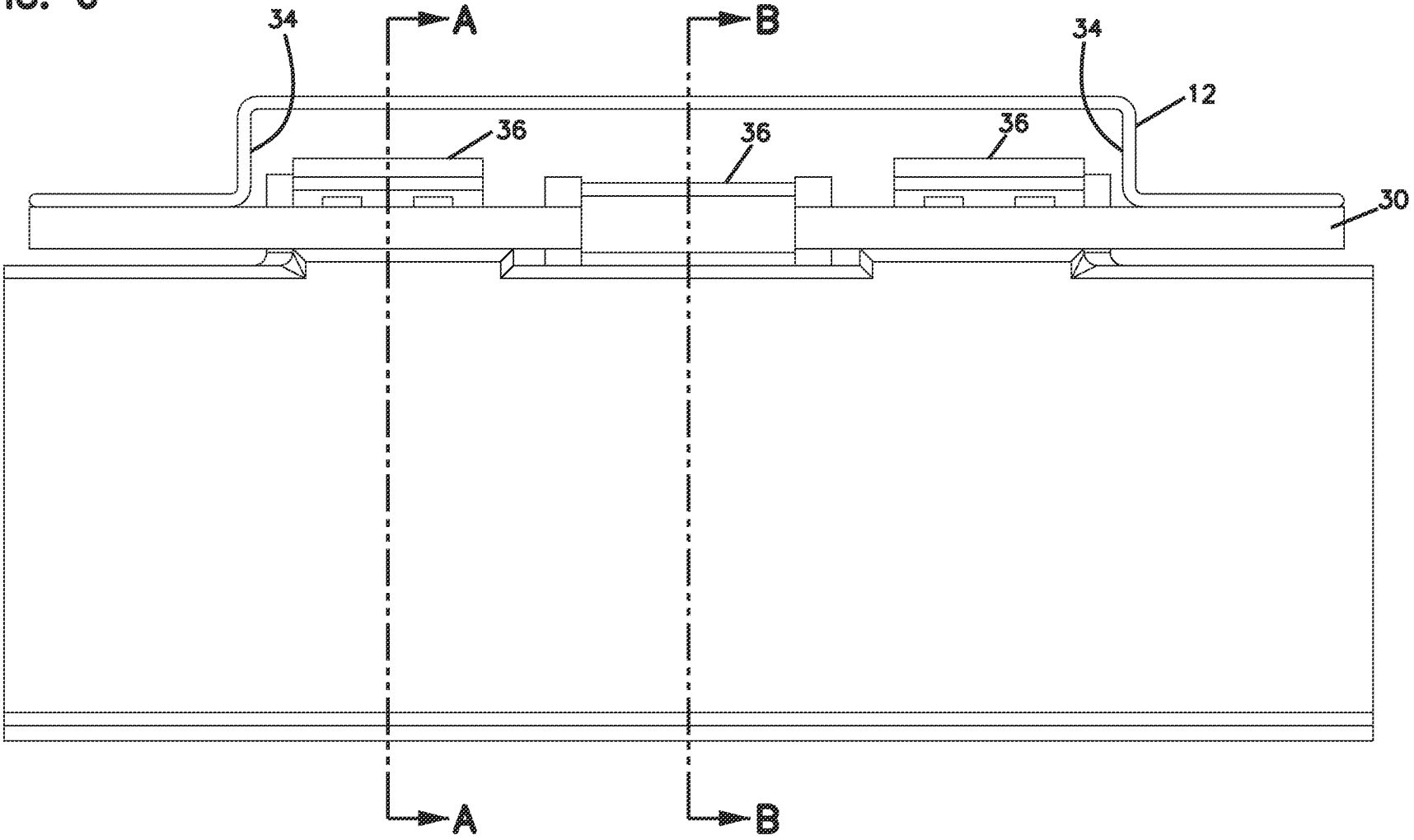
FIG. 6 is a top view of the twist-tie dispenser mounted on the fixture of FIG. 4.
Figure 7:
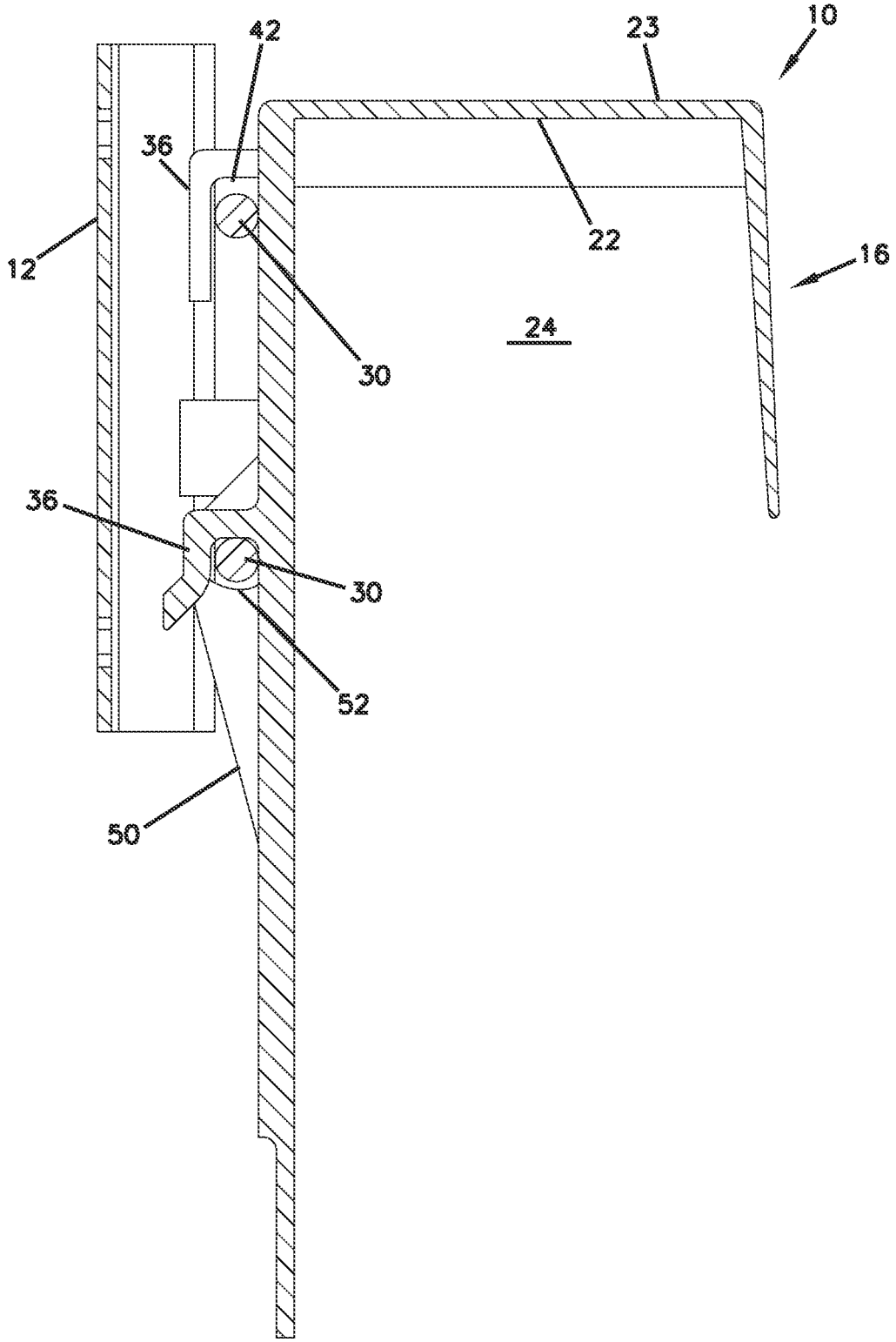
FIG. 7 is a cross-section taken along line A-A of FIG. 6.
Figure 8:
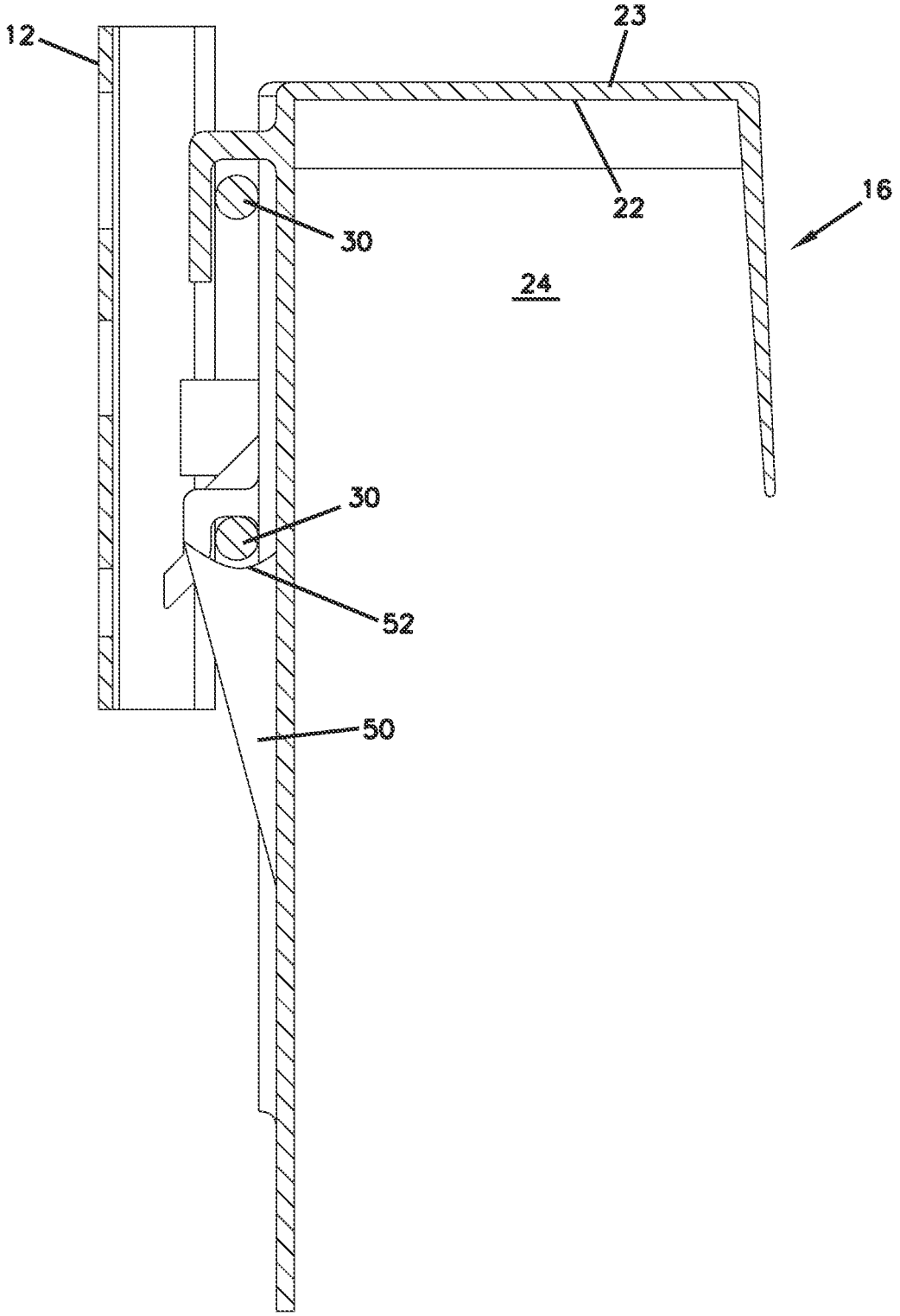
FIG. 8 is a cross-section taken along line B-B of FIG. 6.

Referring to FIGS. 1-8, one embodiment of the twist-tie dispenser 10 includes a base 16 that is used for mounting the dispenser 10 to a fixture 12 at, for example, a grocery store. In FIGS. 1-3, the dispenser 10 is shown separately from the fixture 12, and in FIGS. 4-8, the dispenser 10 is shown mounted on the fixture 12.

As shown in FIGS. 1-8, the base 16 may include a generally U-shaped top portion 18 and a rear portion or wall 20. The rear wall 20 extends downward from the top portion 18. As will be discussed in further detail below, the U-shaped top portion 18 is configured for receiving a twist-tie cluster 14, while the rear wall 20 is configured for removably attaching the base 16 to a fixture 12.

The base 16 could be made of extruded plastic and optionally be at least partially covered with paper, which could include graphics such as logos, trademarks, advertising, and the like.

The twist-tie cluster 14 that is provided as part of the dispenser 10 may include a plurality of twist-ties that are attached to a mounting surface 22 defined by the top portion 18 of the base 16 via, for example, adhesive. Other methods of attaching the twist-tie cluster 14 to the base 16 are also contemplated. For example, the base 16 and the twist-tie cluster 14 may be secured with a securing member selected from the group consisting of an adhesive, at least one staple, and at least one rivet.

In assembling the dispenser 10, a top portion of the twist-tie cluster 14 is received by a pocket 24 formed by the U-shaped top portion 18 of the base 16. The top portion of the cluster 14 is adhered to an inside mounting surface 22 of a top wall 23 of the U-shaped top portion 18 of the base 16. A bottom portion of the twist-tie cluster 14, which is formed from a plurality of separated twist-ties, hangs down from the U-shaped top portion 18 of the base 16 and is exposed to the users from an open front 26 of the base 16. A user can tear off one of the twist-ties by accessing it from the open front 26.

As noted above, rather than simply refilling the twist-tie cluster 14, the dispenser 10 of the present disclosure includes a base 16 that is in effect integral with a twist-tie cluster 14. This has numerous benefits including provision of biodegradable components, lower cost by elimination of a heavy plastic receiver, cleaner appearance of the base 16 due to periodic disposal and replacement with a new base 16, the ability to match advertising on the base 16 with advertising on the twist-ties, etc.

Now referring to FIGS. 1 and 6-8, the rear portion or wall 20 of the base 16 that includes mounting features 28 for removably mounting the base 16 to a fixture 12 is described. It should be noted, as will be described, that the mounting features 28 are configured for mounting and unmounting the base 16 to and from a specific fixture 12 that is generally provided at the user venues, such as grocery stores. As noted above, such a fixture 12 is illustrated in FIGS. 1-8. The example fixture 12 shown in FIGS. 1-8 includes two parallel rod-like mounting structures 30. As will be discussed, the mounting features 28 of the base 16 may be configured and arranged to cooperate with and match the spacing of the rod-like structures 30. Even though shown as including two parallel rod-like mounting structures 30, more or fewer rod-like mounting structures 30 may be provided on the fixture 12, and the dispenser 10 of the present disclosure may be used with more or fewer rod-like mounting structures 30. According to one example embodiment, the rod-like structures 30 may be 3/16" in diameter and the spacing between the two rows of the rod-like mounting structures 30 may be 1¼".

As shown in FIGS. 1-8, the fixture 12 may also define an inset dispenser mounting area 32 (across which the rod-like structures 30 extend) that is bordered by sidewalls 34. The sidewalls 34 are configured to limit sideways movement of the dispenser 10 once the dispenser 10 has been mounted.

Still referring to FIGS. 1-8, the mounting feature 28 of the base 16 that cooperates with the rod-like structures 30 of the fixture 12 defines at least one extension 36. The extension 36 protrudes outwardly from the rear wall 20 of the base 16. The extension 36 defines a hook-like configuration and is configured to receive the elongate, rod-like mounting structures 30 of the fixture 12 to which the twist-tie dispenser 10 is to be mounted.

The at least one extension 36 can include a plurality of extensions 36 as shown in the depicted version of the base 16. In certain embodiments, the at least one extension 36 can include multiple rows of extensions 36 (as in the version shown) such that the twist-tie dispenser 10 can be mounted to a fixture 12 that has multiple parallel elongate rod-like mounting structures 30.

In the embodiment depicted in FIGS. 1-8, two extensions 36 are provided in an aligned but spaced-apart relationship defining a lower row 38, and a single extension 36 is provided thereabove defining an upper row 40.

According to the depicted embodiment, the hook-like configuration defined by each extension 36 defines a pocket 42 formed by an upper stop surface 44 and a vertical retention surface 46.

Still referring to FIGS. 1-8, in addition to the hook-like extensions 36, the mounting features 28 defined at the rear wall 20 of the base 16 may include a flexible portion 48 that is used for latching and unlatching the dispenser 10 to the fixture 12.

The flexible portion 48 acts as a cantilever. The flexible portion 48 may define at least one ramped tab 50. The ramped configuration of the tab 50 provides deflection to the flexible portion 48 as a rod-like structure 30 of the fixture 12 contacts the tab 50. The ramped tab 50 defines a latching surface 52 (also called a lower stop surface 52) that opposes and cooperates with the upper stop surface 44 formed by one of the hook-like extensions 36 for latching the dispenser 10 to the fixture 12. In the depicted version of the dispenser 10, the flexible portion 48 is provided at the center of the two extensions 36 of the lower row 38, and two ramped tabs 50 are provided on the flexible portion 48 of the base 16, each one configured to cooperate with a corresponding extension 36 on the lower row 38. As noted above, the ramps facilitate slidable latching of the dispenser 10 to the fixture 12. The rod-like mounting structures 30 of the fixture 12 can ride along the ramped tabs 50 and elastically deflect the flexible portion 48 as the rod-like mounting structures 30 enter the pockets 42 of the hook-like extensions 36.

When mounting the dispenser 10 to the fixture 12, the cantilevered flexible portion 48 is contacted and elastically flexed out of the way when receiving the elongate rod-like mounting structure 30 into the pockets 42 of the hook-like extensions 36. Once the rod 30 is passed over the ramped tab 50 of the cantilever 48 and enters the pocket 42 to abut the upper stop surface 44, the cantilever 48 flexes back to its original position. The latching or lower stop surfaces 52 of the ramped tabs 50 are configured to cooperate with the upper stop surfaces 44 of the extensions 36 to capture and prevent or limit removal of the rod 30 from the base 16 of the twist-tie dispenser 10.

When the twist-tie cluster 14 is spent and the dispenser 10 needs to be removed and replaced, the flexible portion 48 may be elastically flexed toward the open front 26 of the dispenser base 16 to clear the latching surfaces 52 from the rod-like mounting structures 30 of the fixture 12. In this manner, the dispenser 10 can be lifted off the fixture 12.

The extension 36 provided at the upper row 40 provides stability to the base 16 when mounted on the fixture 12 by cooperating with the other rod-like mounting structure 30 of the fixture 12 that is parallel to the lower rod-like mounting structure 30. In certain embodiment, the upper extension 36 may not be needed.

Figure 9:
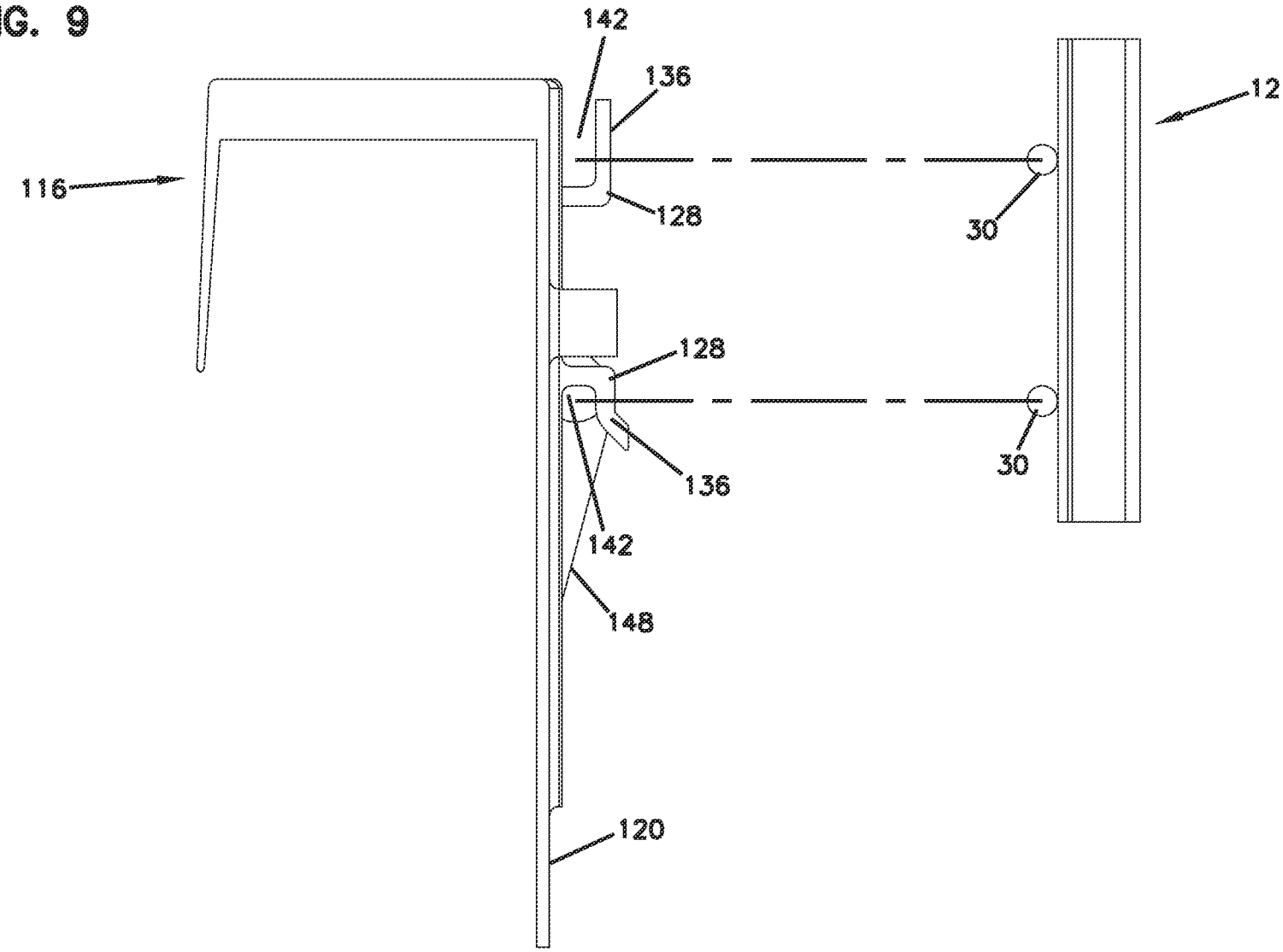
FIG. 9 illustrates a base of a twist-tie dispenser defining an alternative mounting arrangement.
Figure 10:
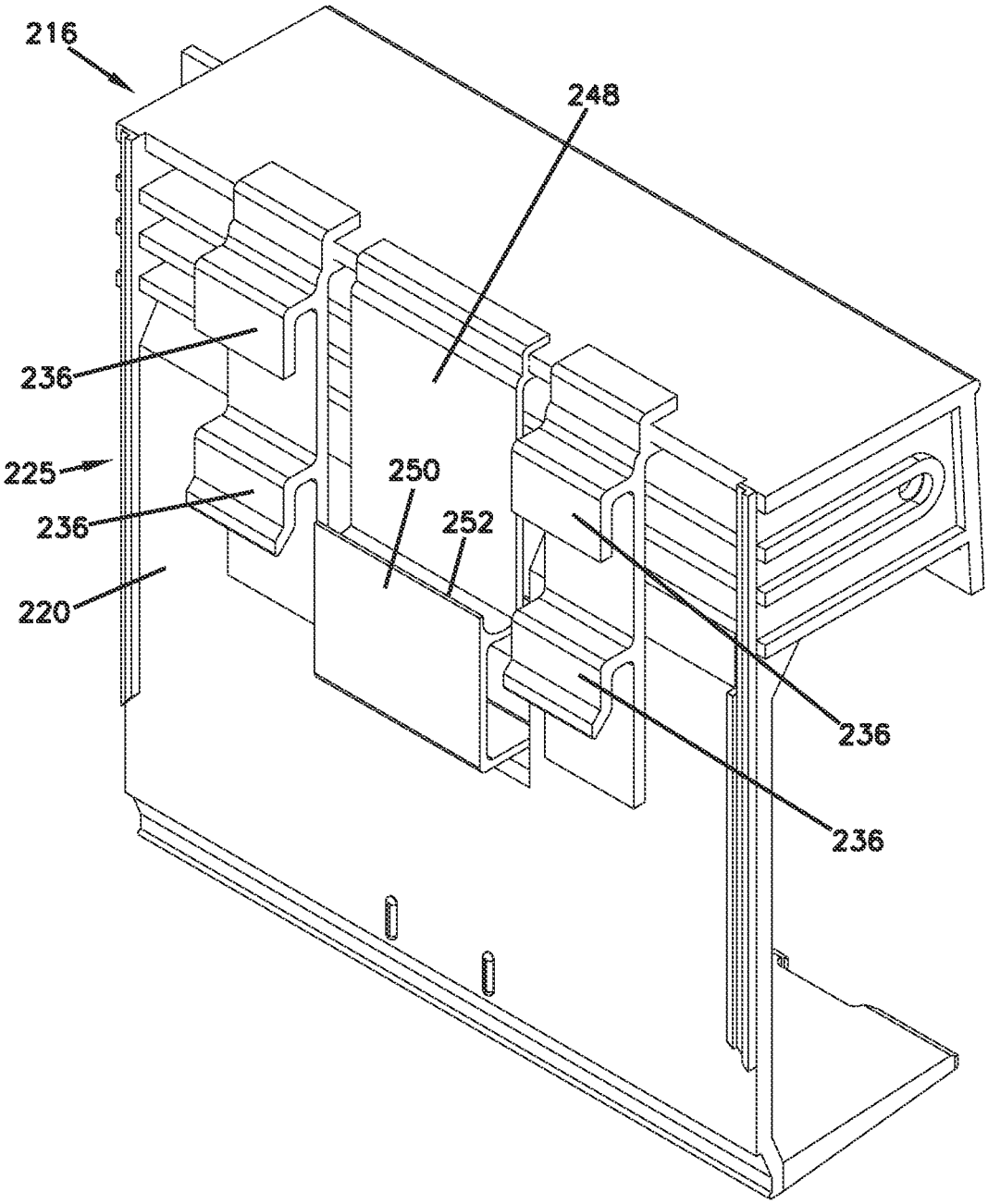
FIG. 10 is a rear perspective of another version of a base of a twist-tie dispenser defining yet another alternative mounting arrangement.
Figure 11:
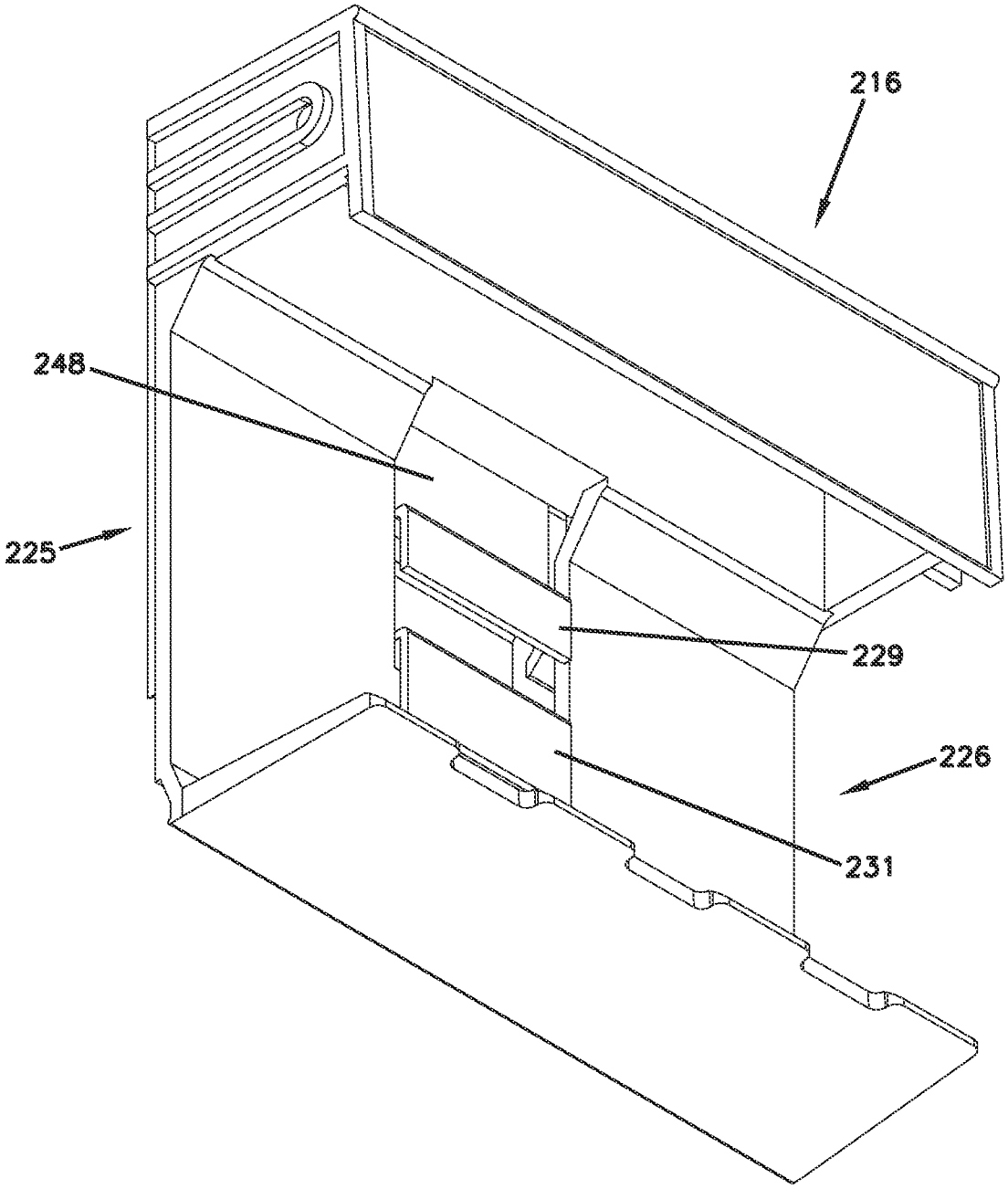
FIG. 11 is a front perspective view of the base of FIG. 10.
Figure 12:
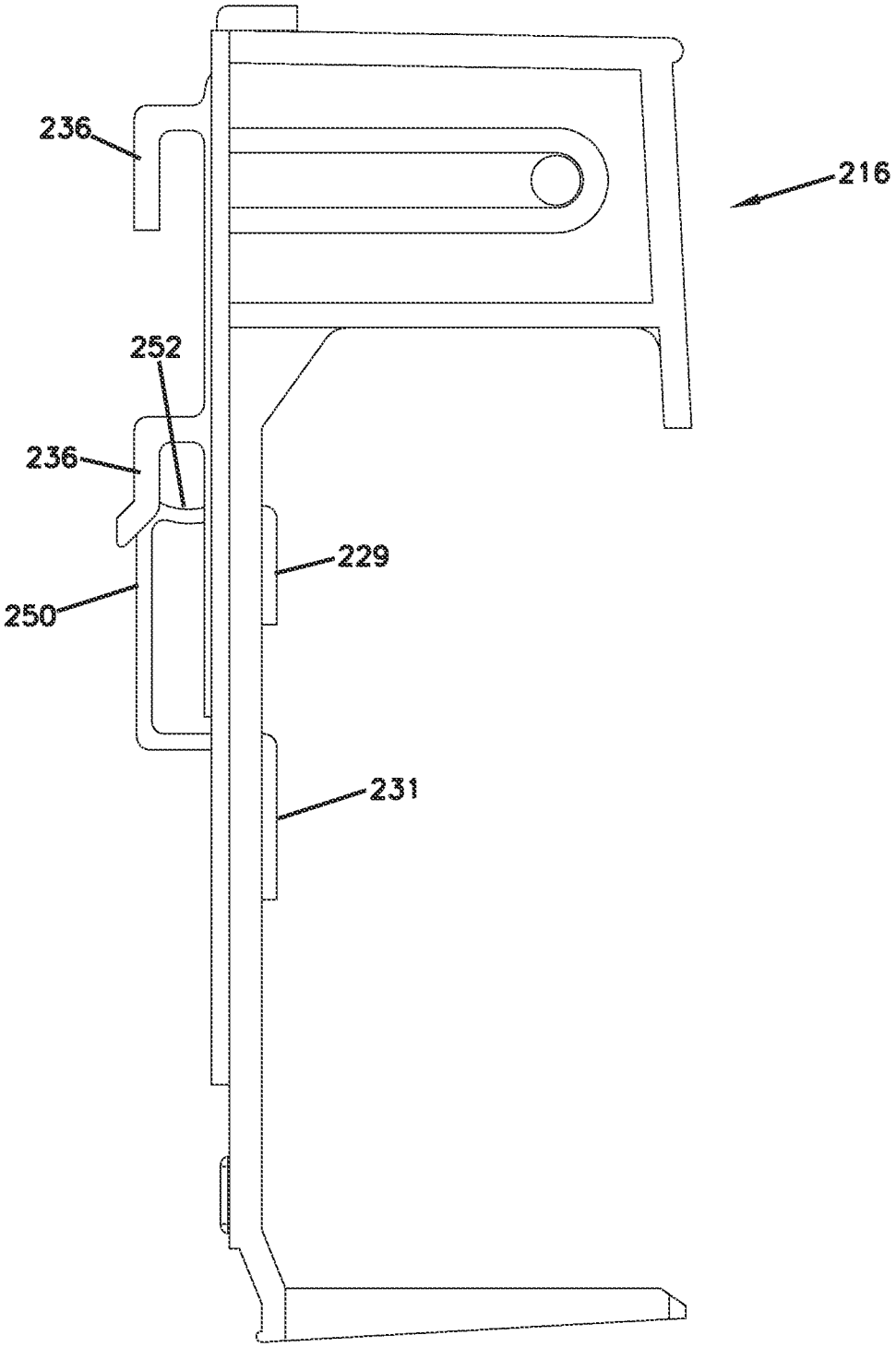
FIG. 12 is a side view of the base of FIG. 10.
Figure 13:
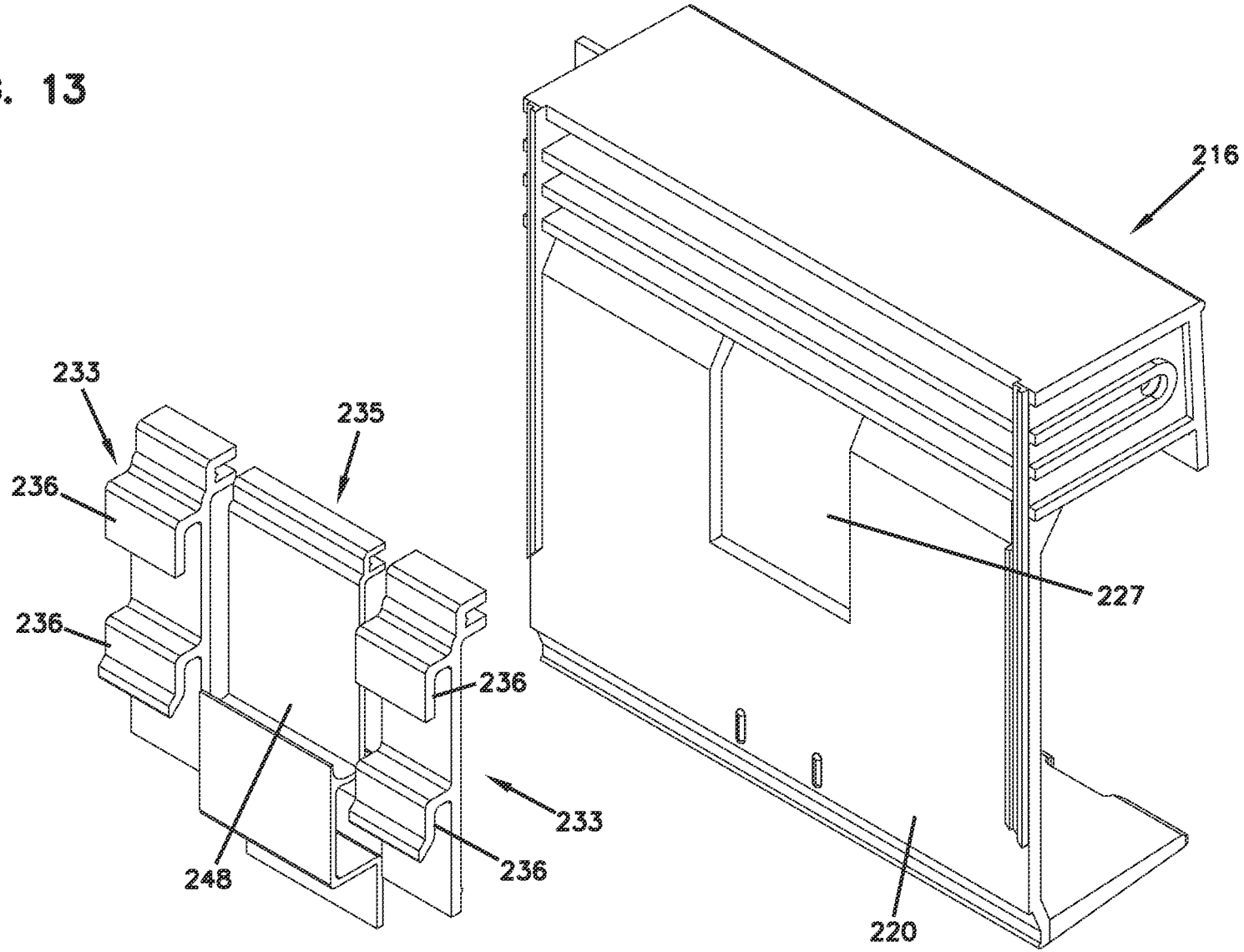
FIG. 13 is a rear perspective view showing the hook-like extensions and the flexible portion separated from the base of the twist-tie dispenser prior to a welding operation.
Figure 14:
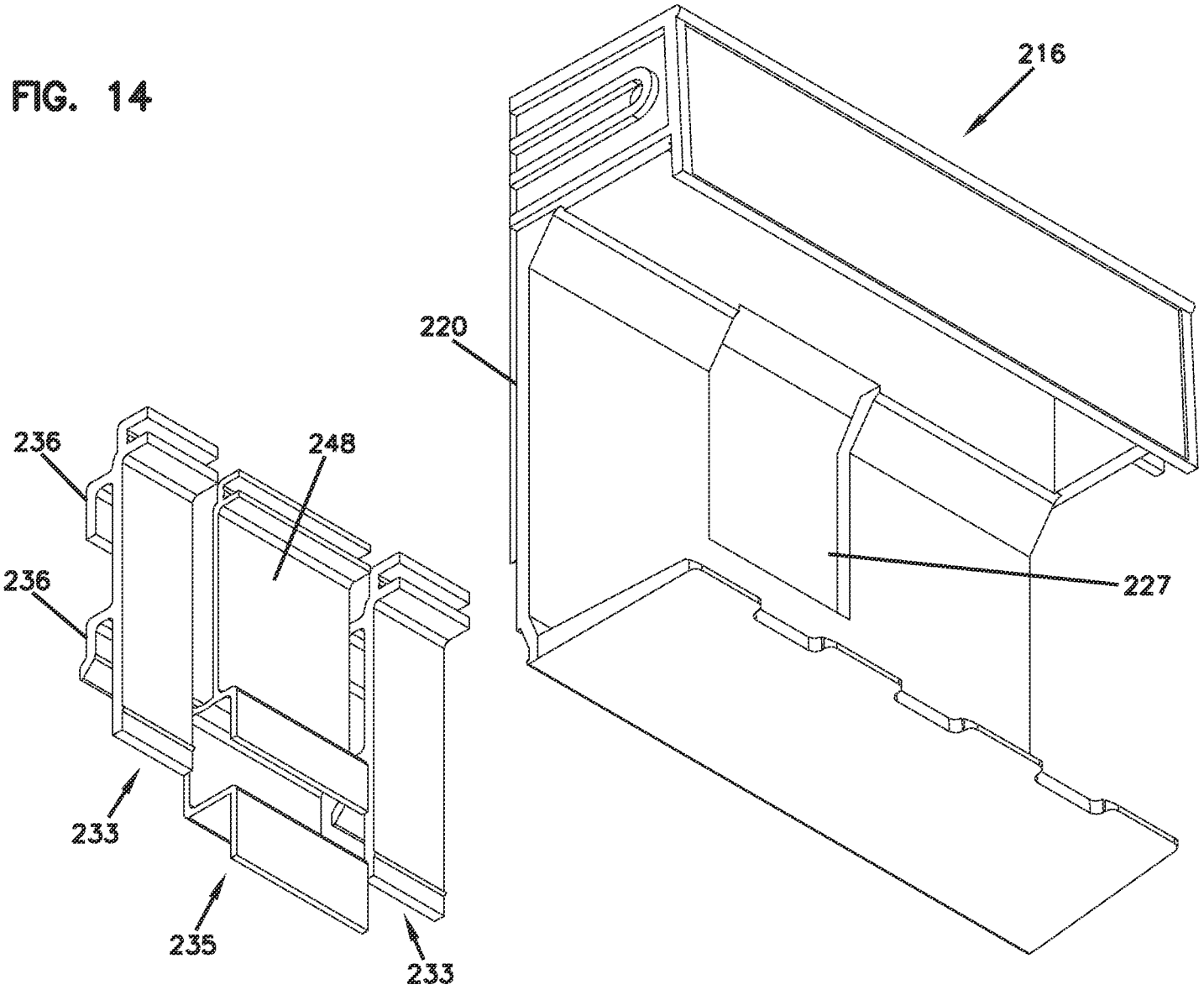
FIG. 14 illustrates the base, the hook-like extensions, and the flexible portion of FIG. 13 from a front perspective view.

FIG. 9 illustrates a base 116 defining an alternative mounting arrangement at the rear wall 120 of the base 116. The mounting features 128 of the base 116 are similar to those of the base 16 of FIGS. 1-8, except that the upper hook-like extension 136 defines a pocket 142 that opens upwardly rather than downwardly. This configuration necessitates a mounting method where the dispenser 110 is initially lifted upwardly, inserting or hooking the upper rod 30 within the pocket 142 of the upper extension 136. The dispenser 110 is then pivoted toward the fixture 12. After the pivoting motion, the dispenser 110 is moved downwardly to insert the lower rod 30 into the pockets 142 of the lower extensions 136 by deflecting the flexible portion 148 out of the way (similar to that of the base 16 of FIGS. 1-8).

FIGS. 10-14 illustrate yet another version of a base 216 having an alternative mounting arrangement at the rear portion 220 of the base 216. The mounting arrangement of the base 216 is similar to those shown for bases 16, 116 in that hook-like extensions 236 and a center flexible portion 248 is used. In the version of FIGS. 10-14, two rows of two extensions 236 each are used. The upper extensions 236, again, are for support and rigidity and the lower extensions 236 are used for latching. The flexible portion 248, in the shown embodiment, defines a single tab 250 that spans the entire width defined between the two lower extensions 236. The center flexible portion 248, as shown in FIGS. 10-14, may be accessed both from the rear 225 of the dispenser 210 and the front 226 of the dispenser 210 when the twist-tie cluster 14 is spent. The flexible portion 248 extends through an opening 227 provided at the rear wall 220 of the base 216 and defines a handle 229 that can be grasped and pulled from the open front 226 of the dispenser 210 for elastically deflecting the flexible portion 248. Upon pulling the handle 229 and deflecting the flexible portion 248, the rod 30 can be cleared from the latching surface 252 of the tab 250 and the dispenser 210 lifted upwardly to remove it from the fixture 12. The flexible portion 248 also defines a stop tab 231 at a lower end thereof to limit opposite rearward deflection of the flexible portion 248 to provide strength to the mounting arrangement.

It should be noted that the mounting arrangement shown in FIGS. 10-14 may be used as a retro-fit measure for dispensers that are not initially provided with the latching structures that have been discussed above. As long as an opening 227 is molded through the rear wall 220 of the base 216, the hook-like extensions 236 and the central flexible portion 248 may be mounted to the rear wall 220 of the base 216 to convert the dispenser to a latching type dispenser 210. The hook-like extensions 236 and the flexible portions 248 may be provided as separate pieces that are ultra-sonically welded (or attached in other ways) to the base 216. Piece parts 233 for the extensions 236 and a piece part 235 for the flexible portion 248 are shown separately from the base 216 (prior to welding) in FIGS. 13-14.

Thus, the hook-like extensions 236 and the flexible portion 248 may provide a conversion structure for converting preexisting non-disposable dispensers to disposable dispensers 210 with minor modification.

Figure 16:
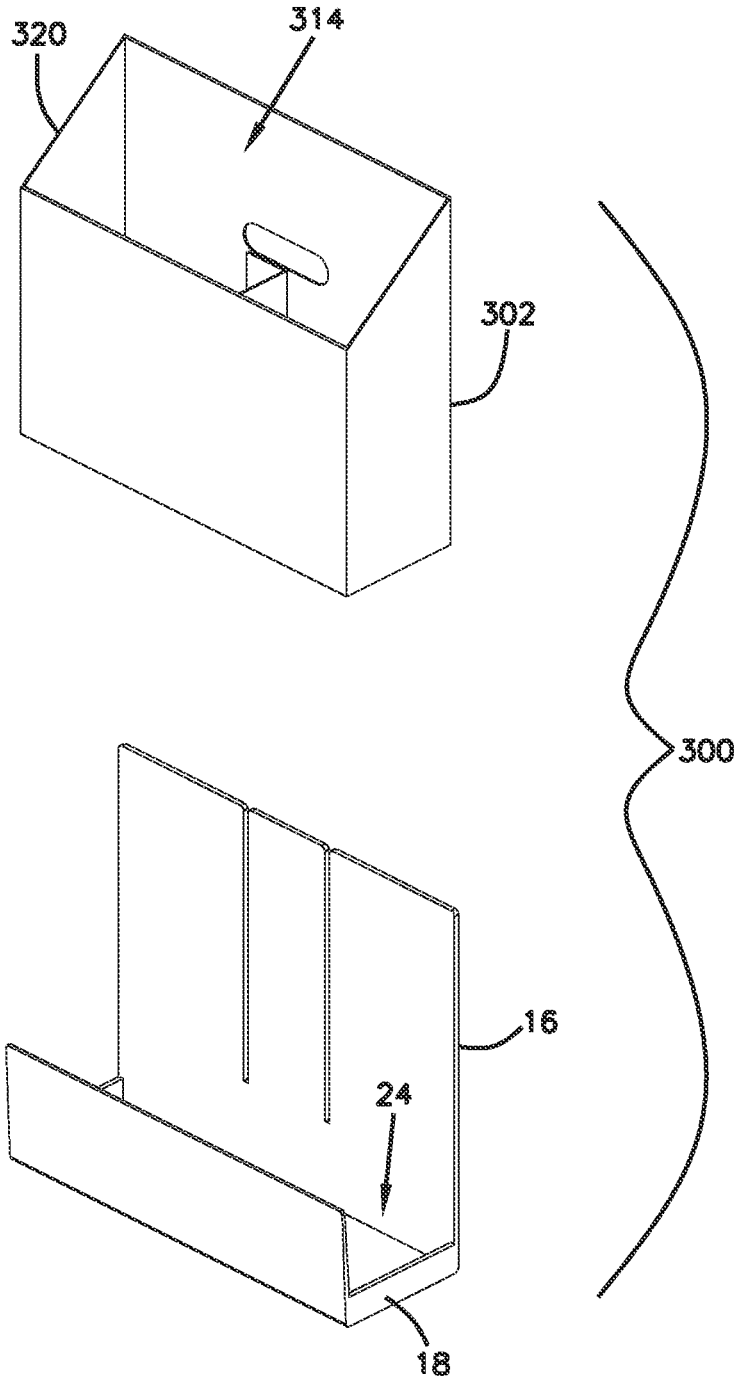
FIG. 16 illustrates, in an exploded configuration, a twist-tie dispensing assembly for dispensing loose twist-ties, the assembly having features that are examples of inventive aspects in accordance with the present disclosure, the assembly formed by orienting the base shown in FIGS. 1-8 upside down and placing a twist-tie storage box within the pocket defined by the base.
Figure 17:
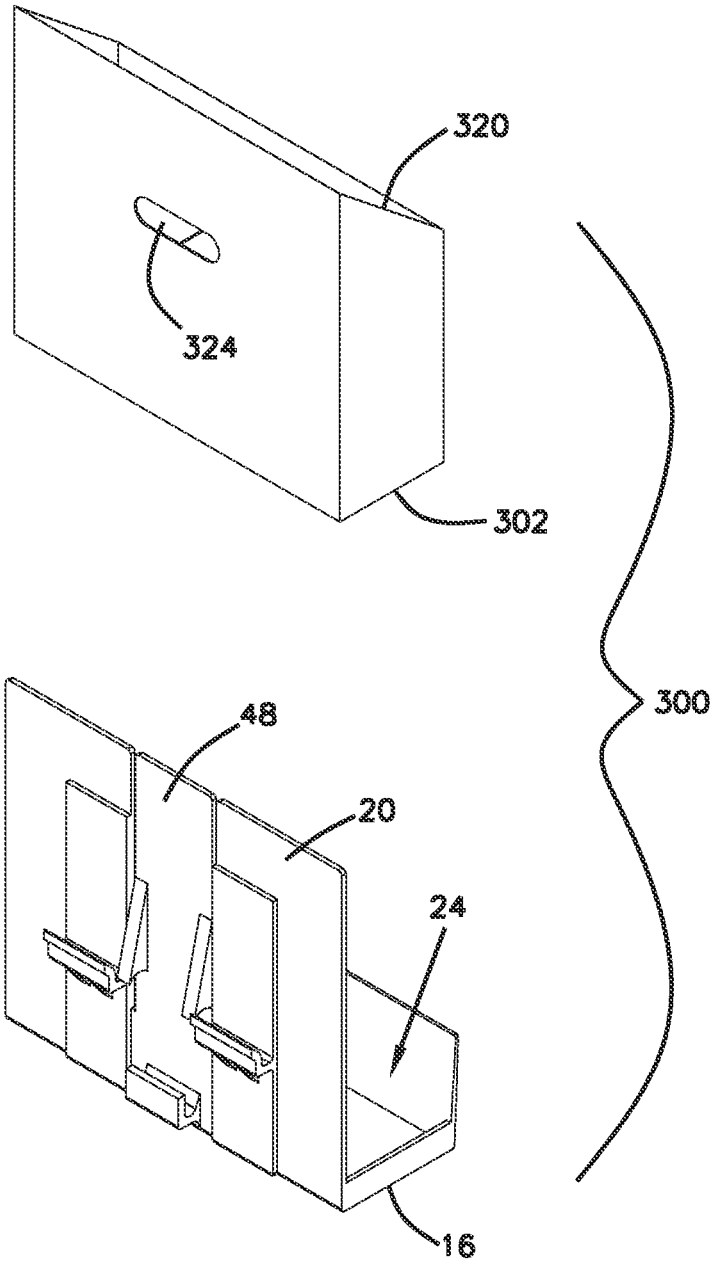
FIG. 17 illustrates the twist-tie dispensing assembly of FIG. 16 from a rear perspective view.
Figure 18:
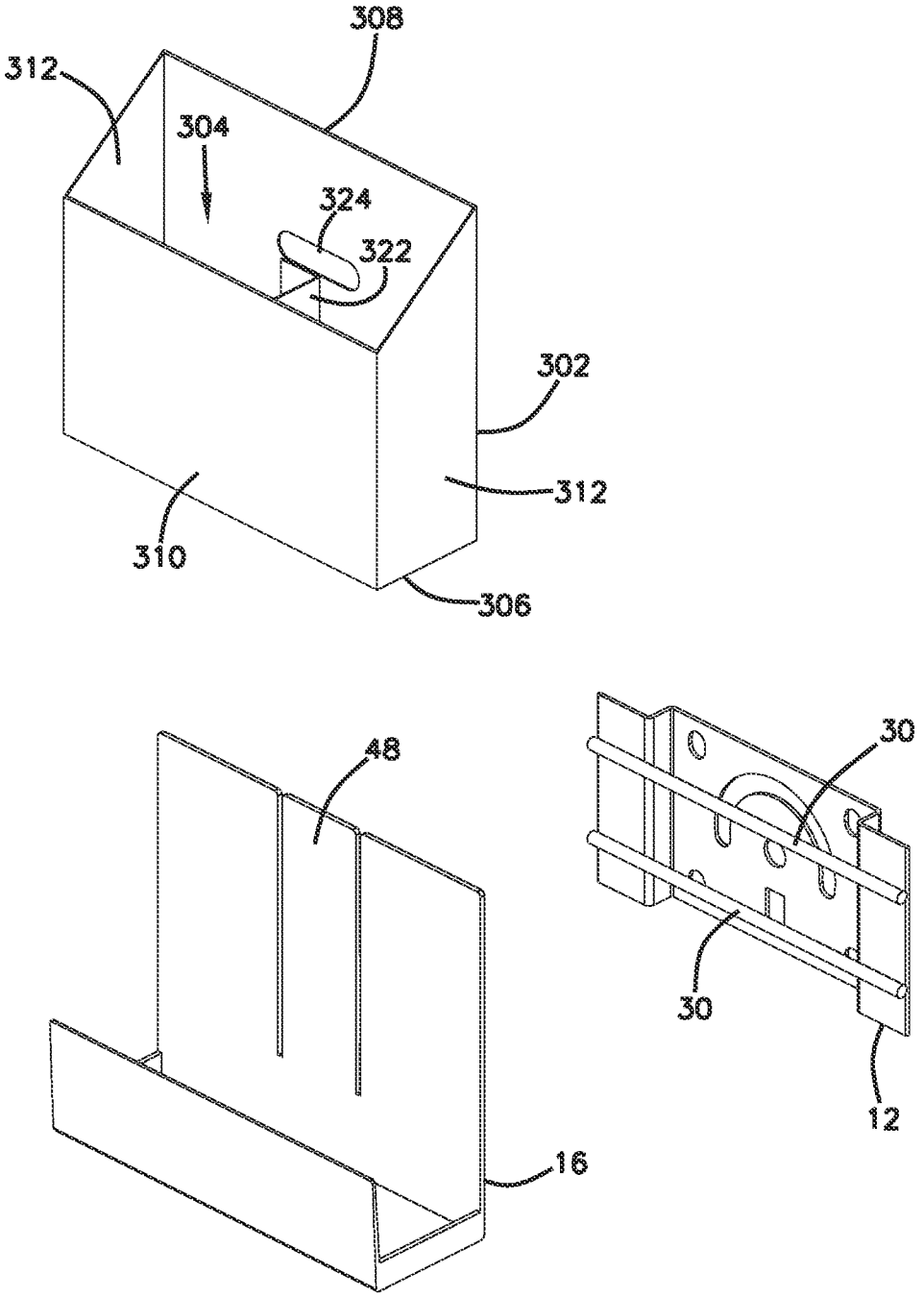
FIG. 18 illustrates the twist-tie dispensing assembly of FIG. 16 in combination with a fixture to which the assembly may be attached, the fixture similar to that shown in FIG. 1.
Figure 19:
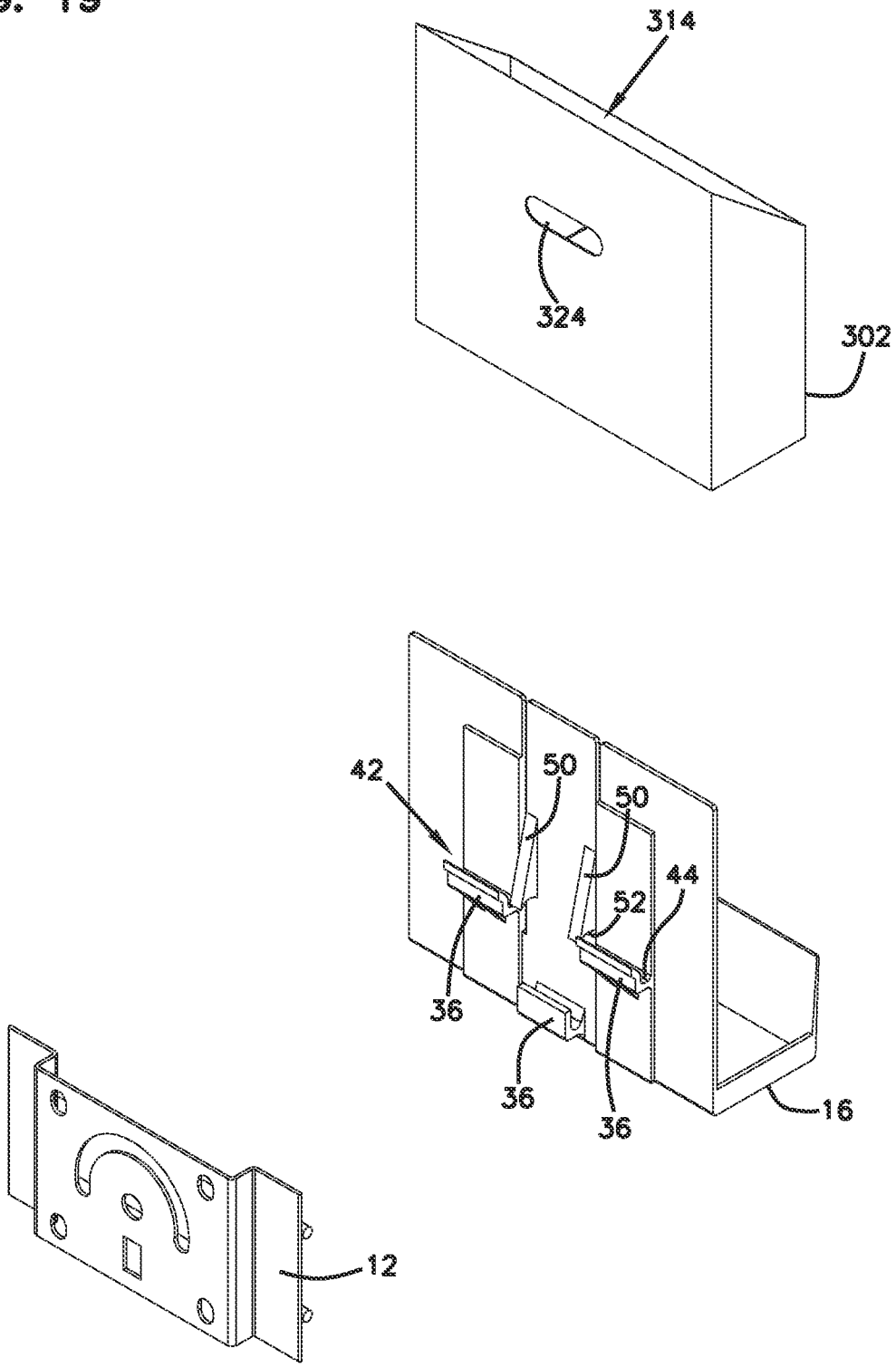
FIG. 19 illustrates the twist-tie dispensing assembly and the fixture of FIG. 18 from a rear perspective view.
Figure 20:
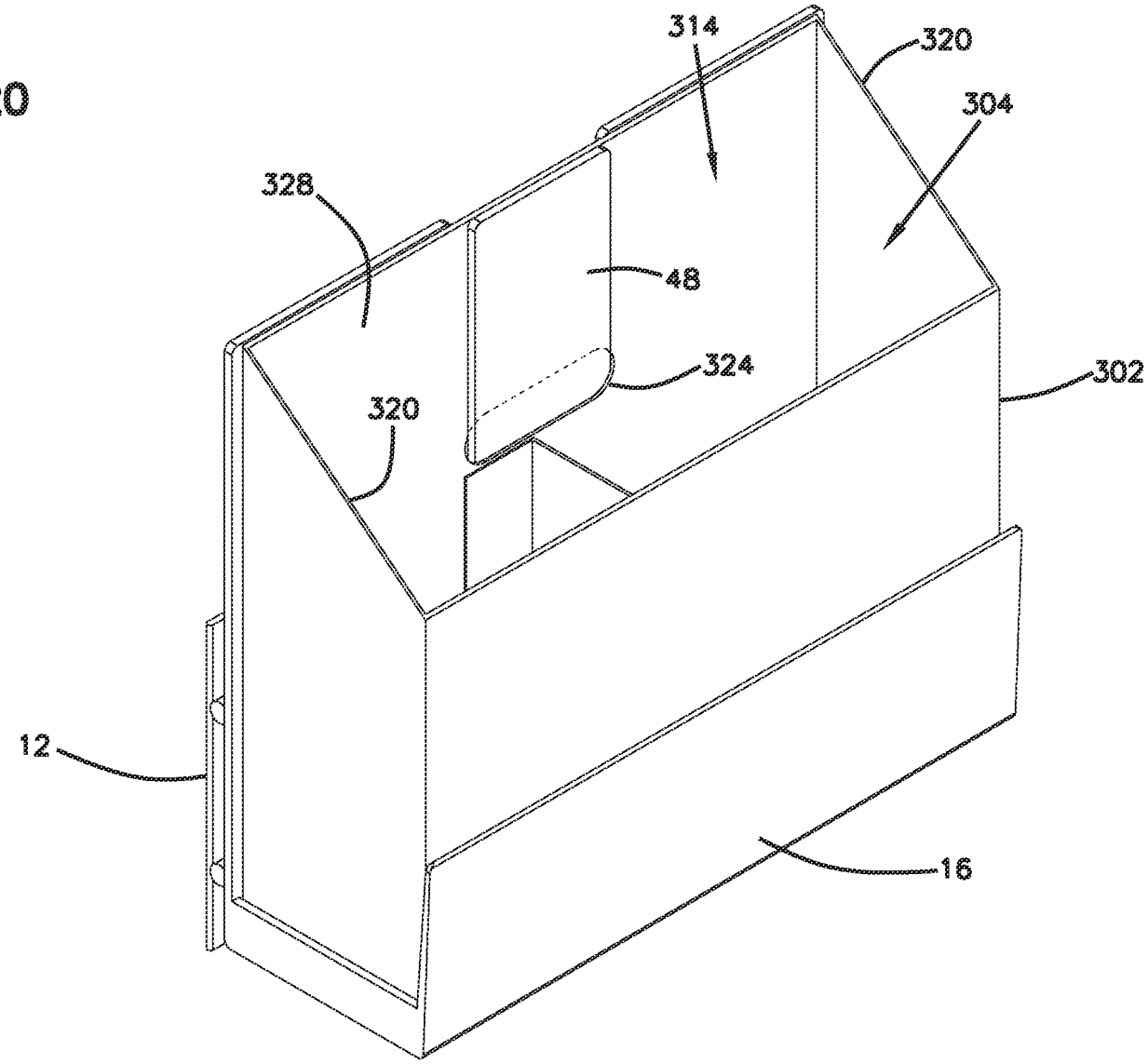
FIG. 20 illustrates the twist-tie dispensing assembly of FIG. 16 in an assembled configuration and mounted to the fixture shown in FIG. 18.
Figure 21:
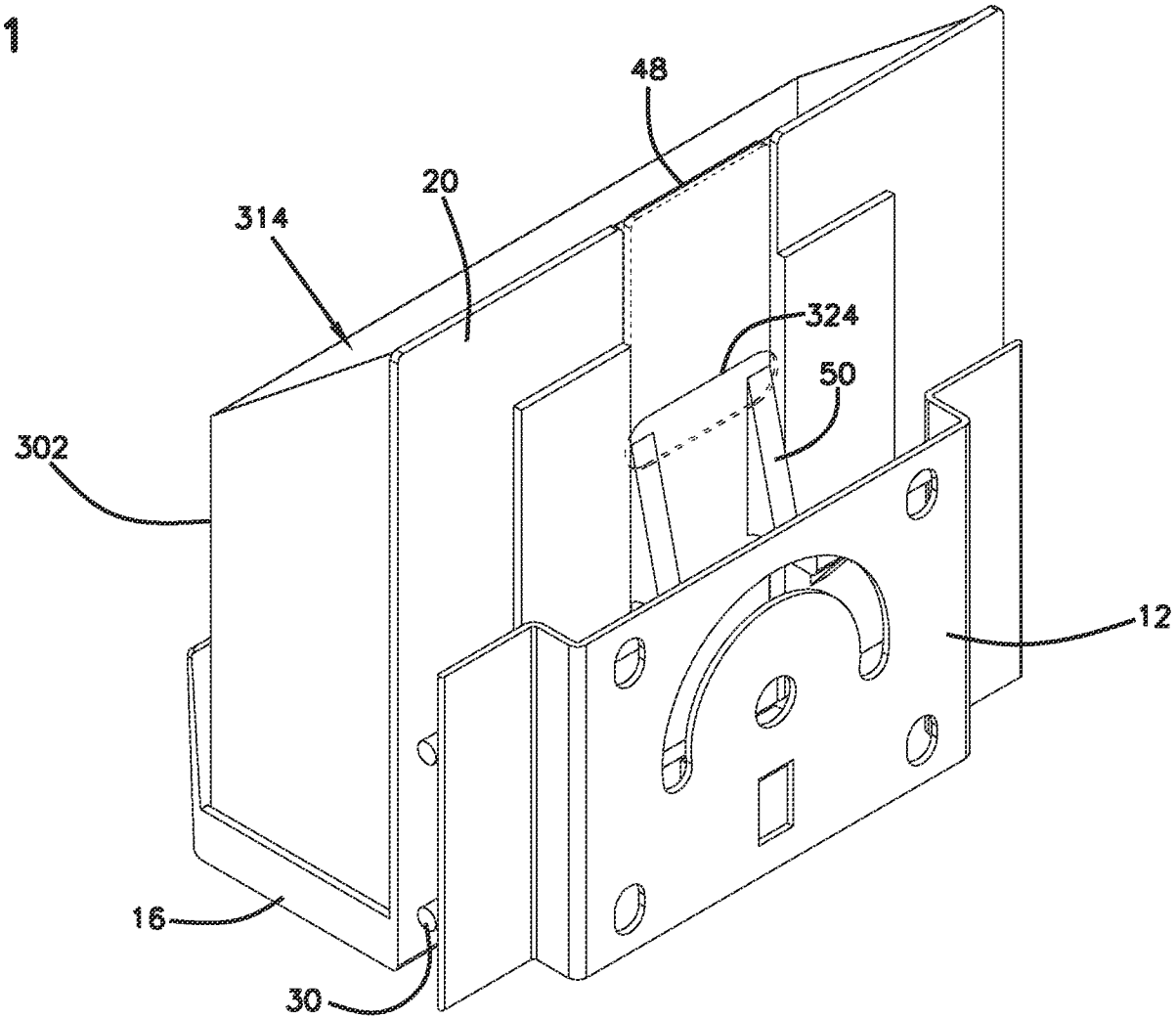
FIG. 21 illustrates the twist-tie dispensing assembly and the fixture of FIG. 20 from a rear perspective view.
Figure 22:
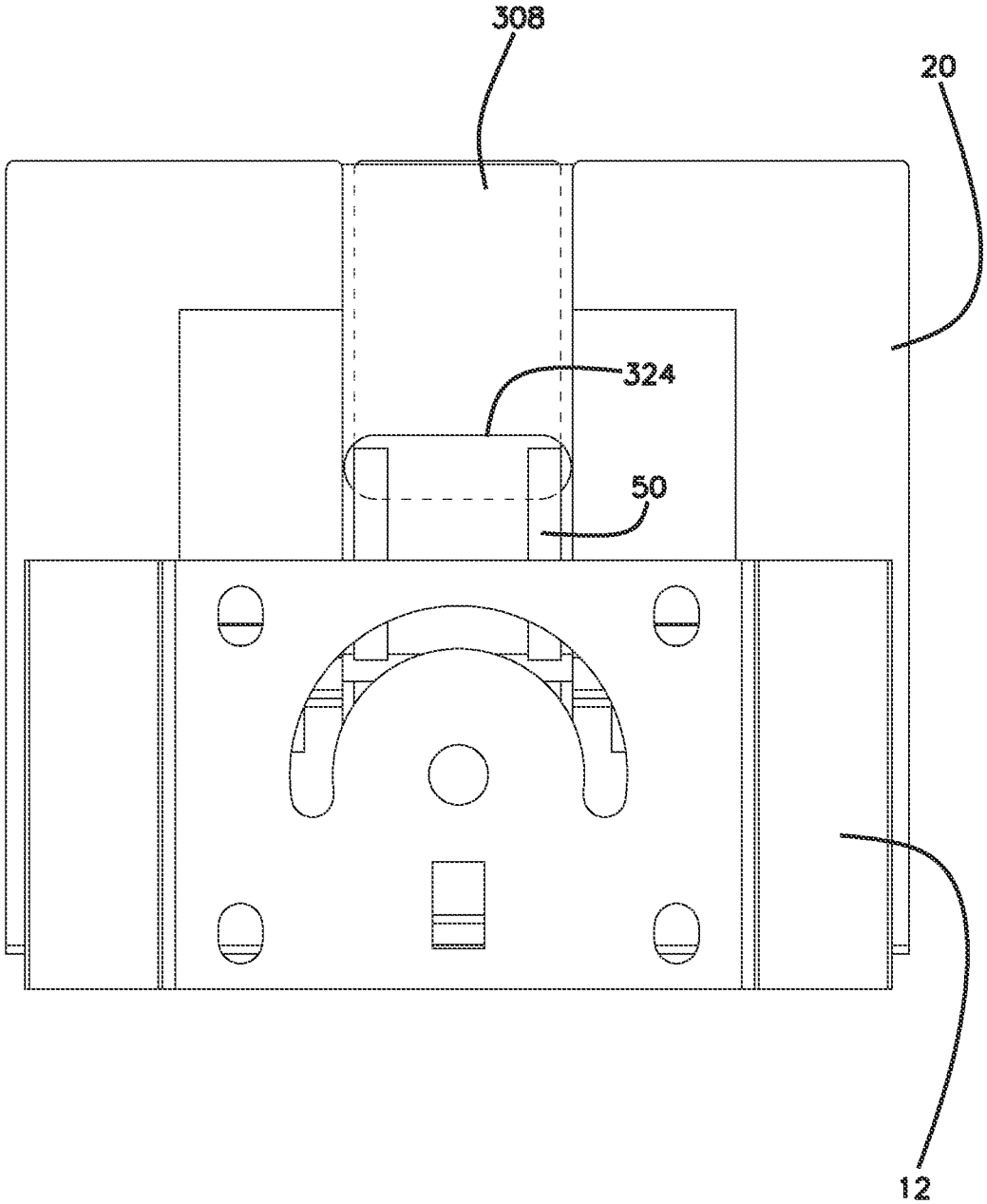
FIG. 22 illustrates the twist-tie dispensing assembly and the fixture of FIG. 20 from a rear view.
Figure 23:
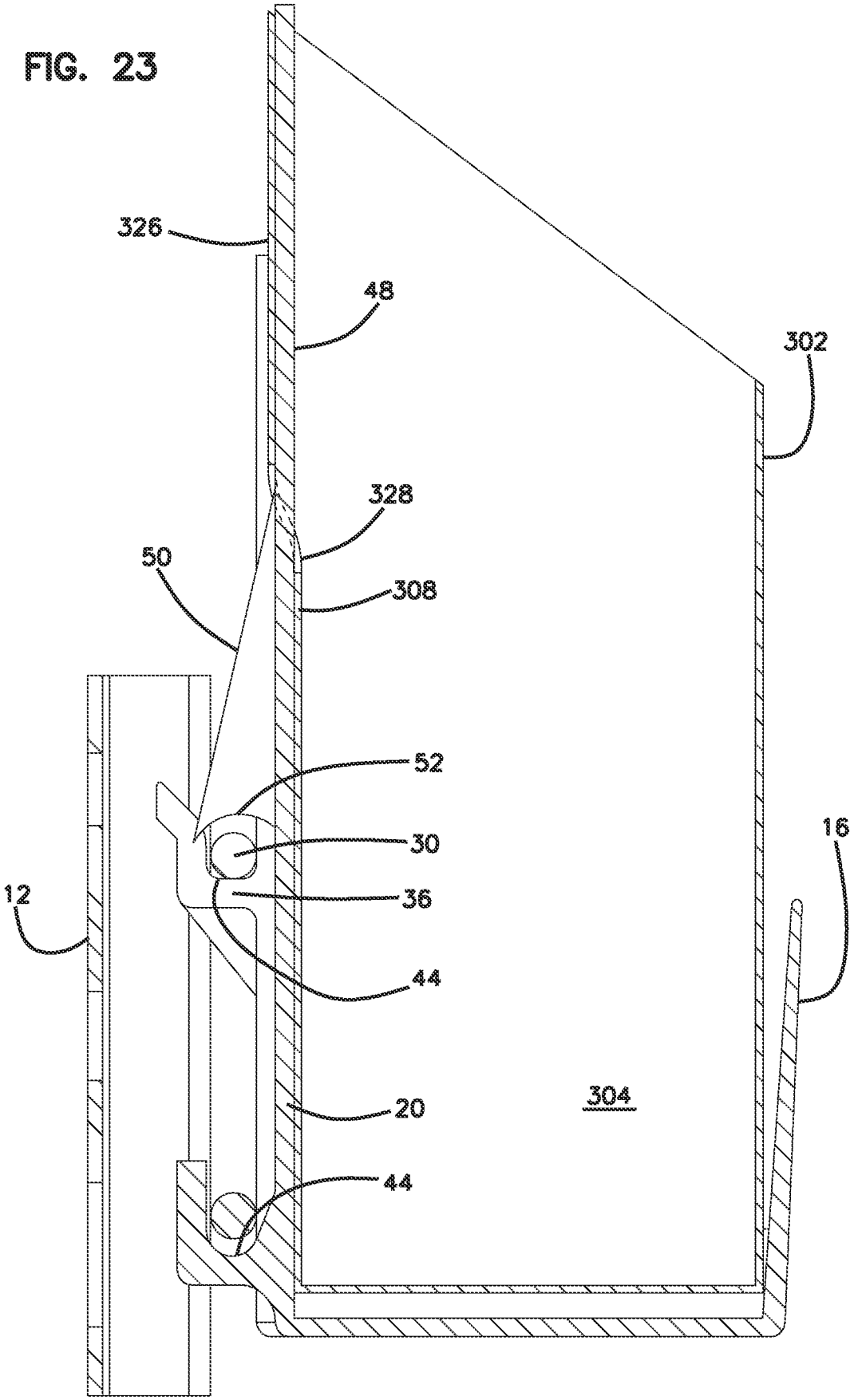
FIG. 23 illustrates a cross-sectional view of the twist-tie dispensing assembly and the fixture of FIG. 22 taken along line 23-23.

Referring now to FIGS. 16 and 17, an example embodiment of a twist-tie dispensing assembly 300 that has features that are examples of inventive aspects in accordance with the present disclosure is illustrated. The twist-tie dispensing assembly 300 is designed for storage and dispensing of loose twist ties 14 in bulk form. The twist-tie dispensing assembly 300 is configured by adding a box 302 to a base that is similar in construction to the base 16 illustrated in FIGS. 1-8 of the present application. However, instead of orienting the base 16 such that the pocket 24 formed by the U-shaped portion 18 is facing downwardly, for the assembly 300, the base 16 is oriented such that the pocket 24 faces upwardly. In this manner, the pocket 24 can receive the box 302 used for storing/displaying loose twist-ties 14 in bulk form.

When the base 16 is used in an upside down orientation, the base 16 is still mountable on fixtures such as the fixture 12 shown in FIGS. 1-9 of the application, wherein the hook-like extensions 36 can still be coupled to the rod-like structures 30 of the fixture 12. When the base 16 is used as shown in FIGS. 18-23, the pocket 42 defined by each hook-like extension 36 faces upwardly for receiving the rod structures 30 of the fixture 12. Since the rod-like structures 30 of the fixture 12 now enter the pockets 42 in a top to bottom direction, the stop surface 44 of each extension 36 acts as a lower stop surface.

When mounting the base 16 to the fixture 12, the cantilevered flexible portion 48 is contacted and elastically flexed out of the way when receiving the elongate rod-like mounting structure 30 into the pockets 42 of the hook-like extensions 36. For the assembly 300, since the base 16 is oriented in the opposite direction with respect to that shown in FIGS. 1-9, the ramped tabs 50 contact the rod-like structures 30 of the fixture 12 as the structures 30 are slid downwardly over the ramped tabs 50, deflecting the cantilevered flexible portion 48 of the base 16 forwardly. Once the rod structures 30 of the fixture 12 enter the pockets 42 of the hook-like extensions 36, they are prevented from removal by the latching surfaces 52 of the ramped tabs. Thus, whereas the latching surfaces 52 are called "lower stop surfaces" for the orientation shown in FIGS. 1-9, for the assembly 300 of FIGS. 16-23, the surfaces 52 act as "upper stop surfaces" for retaining the rod structures 30 within the pockets 42. Once the structures 30 are passed over the ramped tabs 50 of the cantilever 48 and enter the pockets 42 to abut the lower stop surfaces 44, the flexible portion 48 flexes back to its original position. The upper stop surfaces 52 of the ramped tabs 50 are configured to cooperate with the lower stop surfaces 44 of the extensions 36 to capture and prevent or limit removal of the rods 30 from the base 16.

If the base 16 needs to be removed from the fixture 12, the flexible portion 48 of the base 16 may be elastically flexed toward the open front 26 of the base 16 to clear the upper stop surfaces 52 from the rod-like mounting structures 30 of the fixture 12. In this manner, the base 16 can be slid downwardly off the fixture 12.

The extension 36 that is now provided at the lower row provides stability to the base 16 when mounted on the fixture 12 by cooperating with the other rod-like mounting structure 30 of the fixture 12 that is parallel to the now upper rod-like mounting structure 30. In certain embodiments, this lower extension 36 may not be needed.

As noted above, when the base 16 is used in the orientation shown in FIGS. 16-23, the pocket 24 formed by the base 16 now faces upwardly and can receive the box 302 used for storing/displaying loose twist-ties 14 in bulk form.

Figure 24:
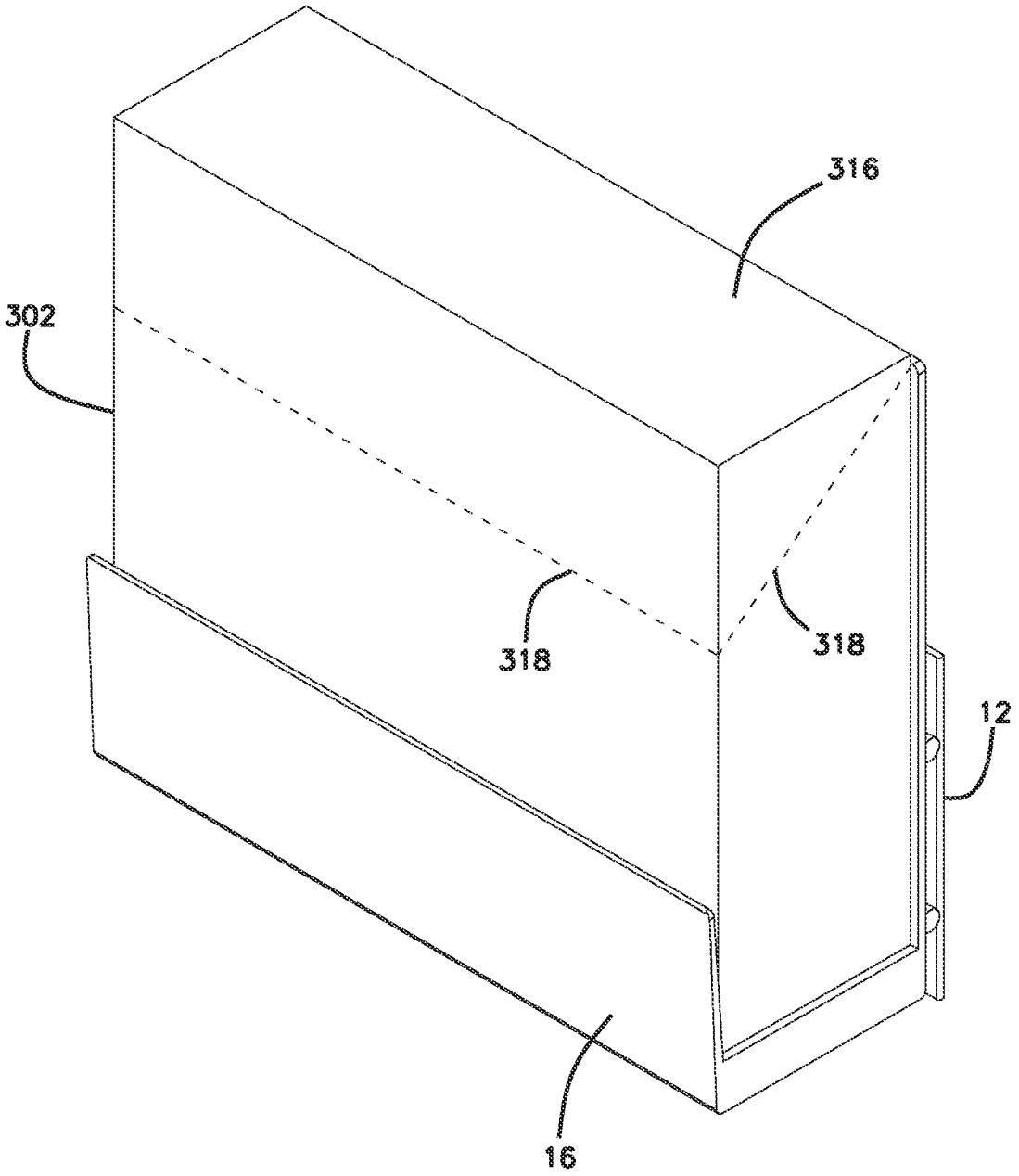
FIG. 24 illustrates the twist-tie dispensing assembly and the fixture of FIG. 20 prior to the cover of the box having been removed.
Figure 25:
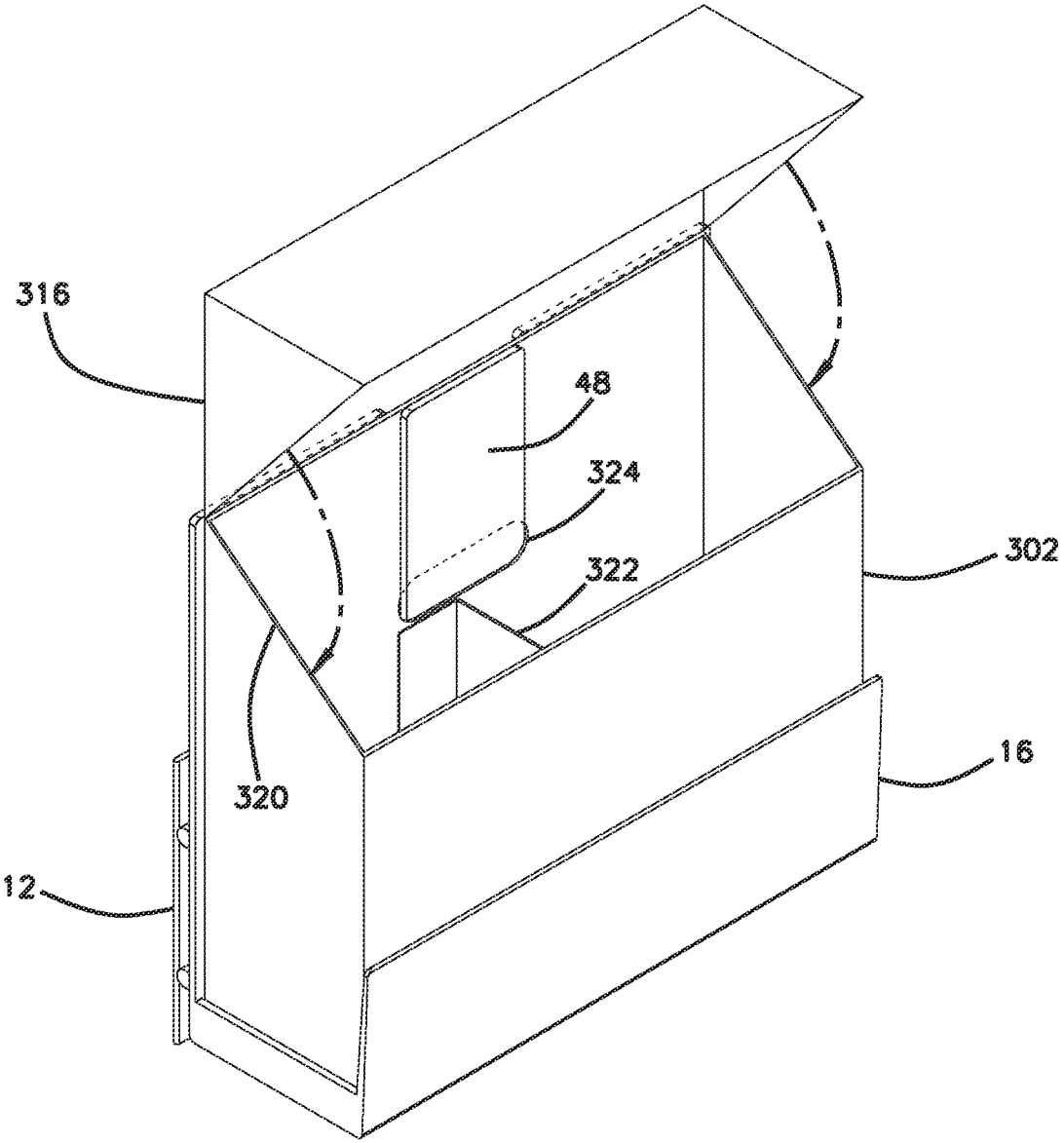
FIG. 25 illustrates the twist-tie dispensing assembly and the fixture of FIG. 24 with another example embodiment of the box that has a hinged, non-removable cover.

As shown in the depicted embodiment, the box 302 defines a storage compartment 304 formed by a bottom wall 306, a back wall 308, a front wall 310, and two sidewalls 312. An opening 314 is provided for accessing the storage compartment 304 for dispensing of the twist-ties 14. Even though the depicted example of the box 302 in FIG. 24 includes a cover or lid 316 that can be torn off via perforated edges 318, other embodiments of the cover such as those that are non-removably mounted (e.g., via a living hinge) are contemplated (as shown in FIG. 25). In the depicted embodiment, the sidewalls 312 of the box define angled edges 320 to provide a larger access portion at the front of the box 302.

It should be noted that the box 302 may be factory filled with the twist-ties 14 and used for transport thereof. And, according to the depicted embodiment, the same box 302 may be used for display and dispensing of the twist-ties 14 simply by removal of its lid 316.

Since the illustrated storage compartment 304 is fairly wide relative to the length of the individual twist-ties 14, one or more dividers 322 may be provided within the box 302. The dividers 322 can separate the storage compartment 304 into smaller portions for generally keeping the remaining twist-ties 14 upright and to prevent them from falling inside as the twist-ties 14 are spent.

According to one example embodiment, the back wall 308 of the box 302 may define a slot 324. As shown in FIGS. 20-23, the slot 324 may be configured such that, when the box 302 is being placed within the pocket 24 of the base 16, the flexible portion 48 of the base 16 can be inserted through the slot 324. The flexible portion 48, as shown, can be inserted from the rear side 326 of the back wall 308 toward the front side 328, wherein the upper half of the flexible portion 48 ends up positioned within the storage compartment 304.

Even though the twist-tie dispensing assembly 300 may be used with the box 302 simply being placed within the pocket 24 formed by the U-shaped portion 18 of the base 16, the coupling of the flexible portion 48 of the base 16 to the box 302 via the slot 324, as shown in FIGS. 20-23 may provide extra stability to the box 302 within the pocket 24 and limit unwanted removal of the box 302 during dispensing of the twist-ties 14. Since the flexible portion 48 is biased rearwardly, a frictional hold is generally created between the box 302 and the rear wall 20 of the base 16. As shown, for example, in the cross-sectional view of FIG. 23, at least a portion of the back wall 308 of the box 302 becomes captured between the flexible portion 48 of the base 16 and the rest of the rear wall 20 of the base 16.

Since the box 302 is held fairly tight due to the frictional fit provided by the flexible portion 48 of the base 16 and the slot 324 of the box 302, during initial set-up of the assembly 300, the box 302 may be placed in the base 16 first, and then the cover 316 may be torn off using the leverage provided by the base 16.

The option of the slot 324 provided in the back wall 308 of the box 302 also provides the advantage of being able to see the color or the type of the factory-filled twist-ties 14 that are in the box 302 prior to tearing off the lid 316.

Figure 26:
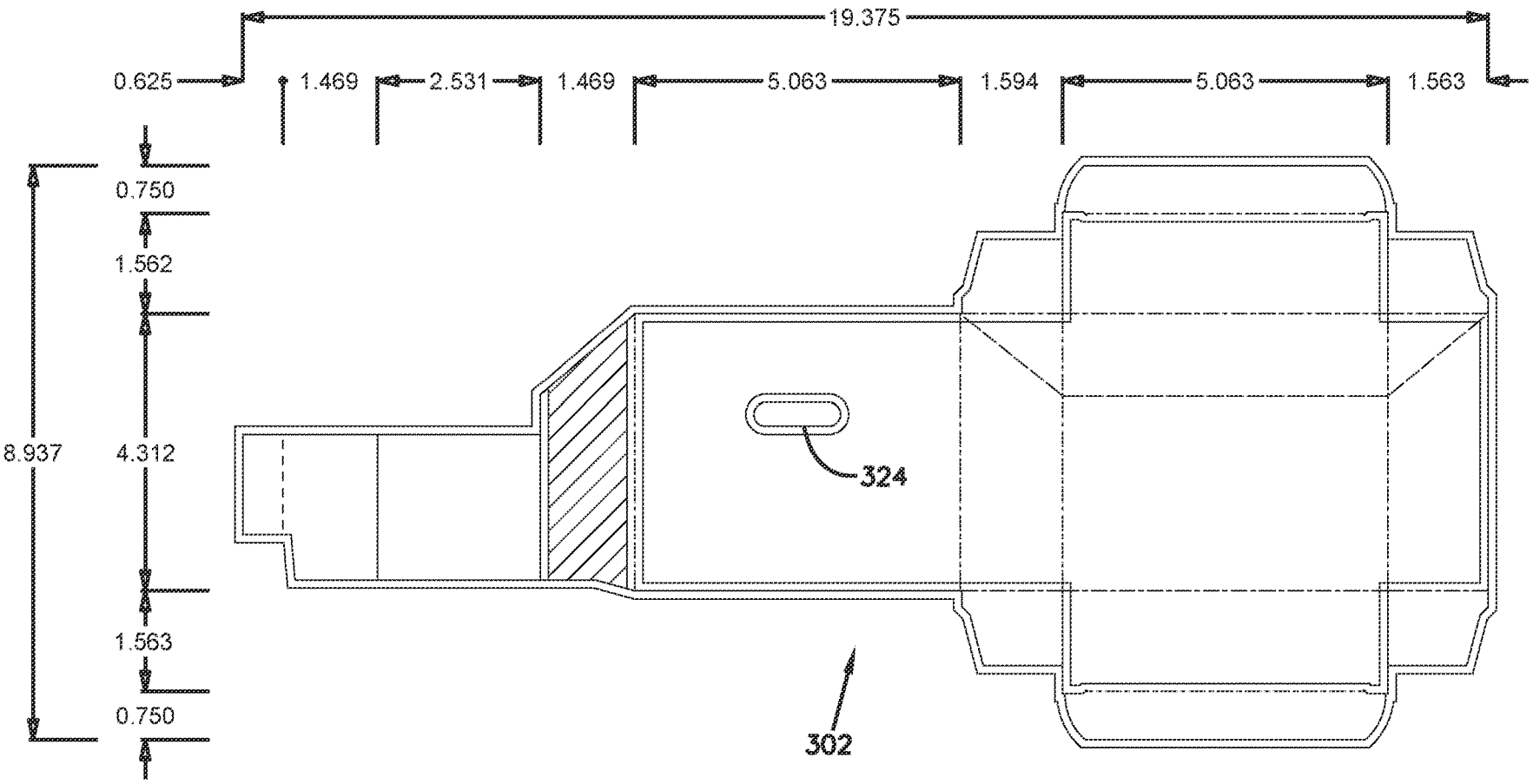
FIG. 26 illustrates the box shown in FIG. 25 in an unfolded configuration.

FIG. 26 illustrates the box 302 in an unfolded configuration.

However, as noted above, the use of the slot 324 of the box 302 and interaction thereof with the flexible portion 48 of the base 16 is simply one option when placing the box 302 within the base 16. As such, in certain embodiments, the box 302 may simply be placed within the base 16. Or, in other embodiments, simply a box without a slot may be used and placed within the pocket 24 formed by the U-shaped portion 18 of the base 16.

It should also be noted that although the base 16, even in the upside down orientation, is capable of being used with the fixture 12 that has the parallel rods 30 as shown in this application, the base 16 with the box 302 may simply be placed in a different type of a fixture, e.g., such as a tray or a plate with a trough deep enough for securely holding the base 16. Other fixtures are certainly contemplated.

The use of the hook-like extensions 36 and the ramped tabs 50 of the base 16 provides the advantage of being able to retrofit the dispenser base 16 to an existing fixture 12 as a bulk twist-tie dispensing system simply by orienting it upside down and placing the storage box 302 within its pocket 24.

The above specification, examples, and data provide a complete description of the manufacture and use of the composition of embodiments of the inventive aspects. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the disclosure. Therefore, it is manifestly intended that the inventive features be limited only by the claims and the equivalents thereof.

The invention claimed is:

1. A product dispensing assembly, comprising:

a base defining a rear wall and an open front, wherein a flexible portion of the rear wall is configured to elastically deflect through a cut-out provided on the rear wall in a direction from the rear wall toward the open front, the base further defining a front wall cooperating with the rear wall to form a U-shaped portion of the base that defines a box-receiving pocket; and a box removably mounted within to the box-receiving pocket defined by the U-shaped portion of the base, the box defining a back wall and a storage compartment configured to hold product, the back wall of the box defining a slot exposing the storage compartment to an exterior of the box, wherein the slot is configured to receive, at least partially, the flexible portion of the rear wall of the base from the exterior of the box toward the storage compartment when the box is mounted within the box-receiving pocket defined by the U-shaped portion of the base, wherein the box-receiving pocket defined by the U-shaped portion of the base defines an entrance that is configured for receiving the box in a direction generally parallel to both the rear wall and the front wall of the base, and wherein when the box is mounted within the box-receiving pocket defined by the U-shaped portion of the base, the back wall of the box is positioned generally parallel to both the rear wall and the front wall of the base.

2. An assembly according to claim 1, wherein the base is made of extruded plastic.

3. An assembly according to claim 1, wherein the box includes a removable cover for exposing the product.

4. An assembly according to claim 3, wherein the removable cover is attached to the box with a perforated edge.

5. An assembly according to claim 1, wherein the base further defines a latching structure configured for removably mounting the base to a fixture including at least one rod-like mounting structure, the latching structure defined at least in part by a first hook-like extension protruding from the rear wall of the base, the first hook-like extension defining a pocket formed by a lower stop surface and a vertical retention surface, the latching structure also defined at least in part by the flexible portion of the rear wall that is configured to elastically deflect through the cut-out provided on the rear wall in a direction from the rear wall toward the open front when the rod-like mounting structure of the fixture is inserted into the pocket of the first hook-like extension, the flexible portion also defining an upper stop surface that opposes the lower stop surface of the first hook-like extension when the rod-like mounting structure is within the pocket of the first hook-like extension and is captured between the lower stop surface and the upper stop surface.

6. An assembly according to claim 5, wherein the base is mounted to the fixture.

7. An assembly according to claim 5, further comprising a second hook-like extension protruding from the rear wall, the second hook-like extension spaced vertically apart from the first hook-like extension and configured to receive a second rod-like structure of the fixture that is spaced vertically apart from and is parallel to the rod-like structure.

8. An assembly according to claim 5, wherein the upper stop surface of the flexible portion is defined by a ramped tab configured to allow the rod-like structure of the fixture to slidably move therealong when deflecting the flexible portion.

9. An assembly according to claim 5, wherein the latching structure defines at least two first hook-like extensions protruding from the rear wall, the at least two first hook-like extensions aligned along a horizontal row.

10. An assembly according to claim 9, wherein the flexible portion of the rear wall is positioned between the at least two first hook-like extensions that are aligned along the horizontal row.

11. An assembly according to claim 10, wherein the flexible portion of the rear wall includes at least two ramped tabs corresponding to the at least two first hook-like extensions, each ramped tab defining the upper stop surface that opposes the lower stop surface of each first hook-like extension, wherein each ramped tab is configured to allow the rod-like structure of the fixture to slidably move therealong when deflecting the flexible portion.

12. A method of assembling a product dispenser, the method comprising:

mounting a removable box having a storage compartment that is configured for holding product to a base defining a rear wall and an open front, wherein a flexible portion of the rear wall is configured to elastically deflect through a cut-out provided on the rear wall in a direction from the rear wall toward the open front, wherein the base further defines a front wall cooperating with the rear wall to form a U-shaped portion of the base that defines a box-receiving pocket, wherein the removable box is mounted within the box-receiving pocket defined by the U-shaped portion of the base; and inserting, at least partially, the flexible portion of the rear wall of the base through a slot defined at a back wall of the box from an exterior of the box toward the storage compartment, wherein the box-receiving pocket defined by the U-shaped portion of the base defines an entrance that is configured for receiving the box in a direction generally parallel to both the rear wall and the front wall of the base, and wherein when the box is mounted within the box-receiving pocket defined by the U-shaped portion of the base, the back wall of the box is positioned generally parallel to both the rear wall and the front wall of the base.

13. A method according to claim 12, further comprising removing a cover of the box to expose the product.

14. A method according to claim 12, further comprising opening a cover of the box to expose the product.

15. A method according to claim 12, wherein the base further defines a latching structure configured for removably mounting the base to a fixture including at least one rod-like mounting structure, the latching structure defined at least in part by a first hook-like extension protruding from the rear wall of the base, the first hook-like extension defining a pocket formed by a lower stop surface and a vertical retention surface, the latching structure also defined at least in part by the flexible portion of the rear wall that is configured to elastically deflect through the cut-out provided on the rear wall in a direction from the rear wall toward the open front when the rod-like mounting structure of the fixture is inserted into the pocket of the first hook-like extension, the flexible portion also defining an upper stop surface that opposes the lower stop surface of the first hook-like extension when the rod-like mounting structure is within the pocket of the first hook-like extension and is captured between the lower stop surface and the upper stop surface.

16. A method according to claim 15, further comprising mounting the base to the fixture by slidably inserting the rod-like structure of the fixture into the pocket of the first hook-like extension until abutting the lower stop surface, and, while slidably inserting the rod-like structure of the fixture into the pocket of the first hook-like extension, deflecting the flexible portion of the rear wall through the cut-out provided on the rear wall until the rod-like structure is captured between the lower stop surface of the first hook-like extension and the upper stop surface defined by the flexible portion.

17. A method according to claim 16, further comprising mounting the base to the fixture prior to mounting the box to the base.

18. A product dispensing assembly, comprising:

a base defining a rear wall and an open front, wherein a flexible portion of the rear wall is configured to elastically deflect through a cut-out provided on the rear wall in a direction from the rear wall toward the open front, the base further defining a front wall cooperating with the rear wall to form a U-shaped portion of the base that defines a box-receiving pocket, the base further defining a latching structure configured for removably mounting the base to a fixture including at least one rod-like mounting structure, the latching structure defined at least in part by a first hook-like extension protruding from the rear wall of the base, the first hook-like extension defining a pocket formed by a lower stop surface and a vertical retention surface, the latching structure also defined at least in part by the flexible portion of the rear wall that is configured to elastically deflect through the cut-out provided on the rear wall in a direction from the rear wall toward the open front when the rod-like mounting structure of the fixture is inserted into the pocket of the first hook-like extension, the flexible portion also defining an upper stop surface that opposes the lower stop surface of the first hook-like extension when the rod-like mounting structure is within the pocket of the first hook-like extension and is captured between the lower stop surface and the upper stop surface; and a box removably mounted within to the box-receiving pocket defined by the U-shaped portion of the base, the box defining a back wall abutting against the rear wall of the base and a storage compartment configured to hold product, wherein the box-receiving pocket defined by the U-shaped portion of the base defines an entrance that is configured for receiving the box in a direction generally parallel to both the rear wall and the front wall of the base, and wherein when the box is mounted within the box-receiving pocket defined by the U-shaped portion of the base, the back wall of the box is positioned generally parallel to both the rear wall and the front wall of the base.

19. An assembly according to claim 18, wherein the back wall of the box defines a slot exposing the storage compartment to an exterior of the box, wherein the slot is configured to receive, at least partially, the flexible portion of the rear wall of the base from the exterior of the box toward the storage compartment when the box is mounted within the box-receiving pocket defined by the U-shaped portion of the base.

20. An assembly according to claim 18, wherein the box includes a removable cover for exposing the product.

* * * * *